US008573507B2

(12) United States Patent
Fujikake et al.

(10) Patent No.: US 8,573,507 B2
(45) Date of Patent: Nov. 5, 2013

(54) FUEL INJECTION DEVICE

(75) Inventors: Fumihiro Fujikake, Tajimi (JP); Yoichi Kobane, Kuwana (JP); Tsukasa Yamashita, Kariya (JP)

(73) Assignee: Denso Corporation, Kariya (JP)

( * ) Notice: Subject to any disclaimer, the term of this patent is extended or adjusted under 35 U.S.C. 154(b) by 86 days.

(21) Appl. No.: 13/076,795

(22) Filed: Mar. 31, 2011

(65) Prior Publication Data

US 2011/0240768 A1 Oct. 6, 2011

(30) Foreign Application Priority Data

Mar. 31, 2010 (JP) ..... 2010-80837
Dec. 2, 2010 (JP) ..... 2010-269641

(51) Int. Cl.
*F02M 41/16* (2006.01)

(52) U.S. Cl.
USPC ..... 239/96; 239/124; 239/585.1; 251/129.15

(58) Field of Classification Search
USPC ..... 239/88, 90, 91, 92, 96, 124, 585.1; 251/129.15
See application file for complete search history.

(56) References Cited

U.S. PATENT DOCUMENTS 6,092,737 A * 7/2000 Bosch et al. ..... 239/96
6,892,955 B2 * 5/2005 Grabandt ..... 239/88

FOREIGN PATENT DOCUMENTS

EP 1 656 498 5/2006
WO WO 2005/019637 3/2005

* cited by examiner

*Primary Examiner* — Christopher Kim
(74) *Attorney, Agent, or Firm* — Nixon & Vanderhye P.C.

(57) ABSTRACT

In a fuel injection device, a pressure control valve is configured to make communication between an outflow port and a return channel and to interrupt the communication so as to control pressure of a fuel in a pressure control chamber, a valve member is configured to open and close a valve portion in response to the pressure of the fuel in the pressure control chamber, and a pressing member is arranged to be reciprocated and displaced in the pressure control chamber. The pressing member has an outer wall surface portion that is opposite to an inner wall surface portion of the control body to be capable of contacting the inner wall surface portion of the control body, and at least one of the outer wall surface portion of the pressing member and the inner wall surface portion of the control body is provided with a recess portion that is recessed to a side separated from the other one of the outer wall surface portion of the pressing member and the inner wall surface portion of the control body.

16 Claims, 9 Drawing Sheets

FUEL INJECTION DEVICE

CROSS REFERENCE TO RELATED APPLICATION

This application is based on Japanese Patent Applications No. 2010-080837 filed on Mar. 31, 2010, and No. 2010-269641 filed on Dec. 2, 2010, the contents of which are incorporated herein by reference in its entirety.

TECHNICAL FIELD

The present invention relates to a fuel injection device that opens and closes a valve portion to control an injection of supply fuel, supplied form a supply channel and injected from a nozzle hole, and that discharges a portion of the supply fuel to a return channel based on the control.

BACKGROUND

There has been known a fuel injection device including a control body, which has a pressure control chamber, and a valve member for opening and closing a valve portion in response to the pressure of fuel in the pressure control chamber. In the fuel injection device, the pressure control chamber of the control body has an inflow port and an outflow port opened therein. The inflow port is a port through which fuel flowing through a supply channel flows into the pressure control chamber, and the outflow port is a port through which the fuel is discharged to a return channel. The pressure of the fuel in the pressure control chamber is controlled by a pressure control valve for making communication between the outflow port and the return channel and for interrupting the communication between them.

In the fuel injection device, a valve member opens and closes a valve portion in accordance with a variation of the fuel pressure in the pressure control chamber. Therefore, it is preferable to rapidly increase or decrease the fuel pressure in the fuel control chamber, with respect to a switch operation between the communication of the outflow port and the return channel, and the interruption of the communication. In a fuel injection device disclosed in a patent document 1 (EP Patent No. 1656498), a pressing member is further provided in a pressure control chamber, to be reciprocally displaced in the pressure control chamber. When the outflow port is made to communicate with the return channel by the pressure control valve, the pressing member is drawn to the abutting surface having the outflow port opened therein by the flow of the fuel flowing to the outflow port from the pressure control chamber, thereby pressing the abutting surface by a pressing surface of the pressing member. When the communication of the inflow port, the pressure control chamber and the outflow port is interrupted by the pressing member pressed to the abutting surface, the pressure of the fuel in the pressure control chamber is rapidly decreased.

When the communication between the outflow port and the return channel are interrupted by the pressure control valve, the pressing member receives pressure in a direction to separate the pressing surface from the abutting surface by the flow of the fuel flowing into the pressure control chamber from the inflow port. When the inflow port, the pressure control chamber and the outflow port are brought into the state of communication by the displacement of the pressing member, the pressure of the fuel in the pressure control chamber is rapidly increased.

As described above, the pressing member displaces to be reciprocated in accordance with the switch operation of the pressure control valve between the communication of the outflow port and the return channel, and the interruption thereof. Therefore, it is possible to rapidly increase or decrease the fuel pressure in the pressure control chamber.

In the fuel injection device disclosed in the patent document 1, the pressing member movable in the pressure control chamber may contact an inner wall surface of a control body, which encloses the abutting surface exposed to the pressure control chamber. If an outer wall surface of the pressing member contacts an inner wall surface of the control body, the fuel cannot be normally held between the outer wall surface of the pressing member and the inner wall surface of the control body at the contact portion. In this case, the outer wall surface of the pressing member may be pressed to the inner wall surface of the control body, due to the fuel pressure in the pressure control chamber. Thus, it may be difficult for the pressing member to be smoothly reciprocated in the pressure control chamber, and thereby response of the pressure control valve for switching between the communication of the outflow port and the return channel, and the interruption thereof may be deteriorated.

SUMMARY

In view of the foregoing problems, it is an object of the present invention to provide a fuel injection device, which improves a response of a pressing member with respect to a switch operation of a pressure control valve.

According to an aspect of the present invention, a fuel injection device is adapted to open and close a valve portion for controlling an injection of supply fuel supplied from a supply channel and injected from a nozzle hole, and to discharge a portion of the supply fuel into a return channel based on the control. The fuel injection device includes: a control body that is provided with a pressure control chamber, into which the fuel flowing through the supply channel flows from an inflow port and from which the fuel is discharged to the return channel through an outflow port, and an abutting surface exposed to the pressure control chamber and having the inflow port and the outflow port opened therein; a pressure control valve configured to make communication between the outflow port and the return channel and to interrupt the communication so as to control pressure of the fuel in the pressure control chamber; a valve member configured to open and close the valve portion in response to the pressure of the fuel in the pressure control chamber; and a pressing member arranged to be reciprocated and displaced in the pressure control chamber, and having a pressing surface opposite to the abutting surface. The pressing surface of the pressing member presses the abutting surface to interrupt communication between the inflow port and the pressure control chamber when the communication between the outflow port and the return channel is made by the pressure control valve, and the pressing surface of the pressing member is displaced and separated from the abutting surface to open the inflow port of the abutting surface to the pressure control chamber when the communication between the outflow port and the return channel is interrupted by the pressure control valve. The pressing member has an outer wall surface portion that is opposite to an inner wall surface portion of the control body to be capable of contacting the inner wall surface portion of the control body. Furthermore, at least one of the outer wall surface portion of the pressing member and the inner wall surface portion of the control body is provided with a recess portion that is recessed to a side separated from the other one of the outer wall surface portion of the pressing member and the inner wall surface portion of the control body. Accordingly, fuel can be held in the recess portion, and the outer wall surface portion of the pressing member is pressed by a force from the fuel held in the recess portion to be separated from the inner wall surface portion of the control body. Furthermore, because the recess portion is provided, a contact area between the outer wall surface portion of the pressing member and the inner wall surface portion of the control body can be reduced, and thereby attracting force between the outer wall surface portion of the pressing member and the inner wall surface portion of the control body can be reduced. Therefore, the pressing member can be smoothly reciprocated and displaced in the pressure control chamber, thereby improving response of the pressing member with respect to switch operation of the pressure control valve between the communication and the interruption.

For example, the inner wall surface portion of the control body includes a cylindrical inner peripheral wall surface portion extending in an axial direction, the cylindrical inner peripheral wall surface portion is provided opposite to the outer wall surface portion of the pressing member in a radial direction of the cylindrical inner peripheral wall surface portion, and at least one of the cylindrical inner peripheral wall surface portion of the control body and the outer wall surface portion of the pressing member is provided with the recess portion. In this case, the recess portion may be provided symmetrically with respect to the axial direction. Furthermore, the recess portion may be a ring shape extending circularly around the axial direction. In addition, the outer wall surface portion of the pressing member may be slidable with respect to the cylindrical inner peripheral wall surface portion of the control body when the pressing member is displaced in the pressure control chamber.

Alternatively/Furthermore, the recess portion may be provided in the outer wall surface portion of the pressing member to be recessed inside of the pressing member.

In the fuel injection device, the inner wall surface portion of the control body may include a cylindrical inner peripheral wall surface portion extending in an axial direction of the pressing member, and a stopper surface portion provided to contact a contact surface portion of the floating plate opposite to the pressing surface portion in the axial direction, thereby regulating displacement of the pressing member between the abutting surface and the stopper surface portion. Furthermore, at least one of the contact surface portion of the pressing member and the stopper surface portion may be provided with the recess portion such that the contact surface portion of the pressing member line-contacts the stopper surface portion at a contact portion.

In addition, the recess portion may be provided in the stopper surface portion such that the contact surface portion of the pressing member line-contacts the stopper surface portion. The control body may have a support portion configured to support the stopper surface portion, and the support portion may have a radial dimension in an axial cross section of the control body. In this case, the radial dimension is increased in the axial direction as toward a side of the valve member in the axial direction.

Furthermore, the contact portion may be positioned closer to an inner periphery of the stopper surface portion than an outer periphery of the stopper surface portion, and the recess portion may be a shape symmetrical with respect to the axial direction. For example, the recess portion may be a circular ring shape extending around the axial direction.

The recess portion may be formed in the control body continuously in a range from the inner wall surface portion to the stopper surface portion. Alternatively, the inner wall surface portion and the stopper surface portion of the control body may be respectively provided with the recess portions separated from each other.

In the fuel injection device, the pressing member may be a cylindrical shape having the pressing surface with a circular shape, the pressing member may have therein a communication hole through which the outflow port communicates with the pressure control chamber when the pressing surface abuts on the abutting surface, and the communication hole may extend in the pressing member from a center portion of the pressing surface in the axial direction.

Furthermore, the control body may include a valve body member defining the abutting surface, and a cylinder member that defines the pressure control chamber together with the valve body member. In this case, the cylinder member may be provided with the inner wall surface portion that is capable of contacting the outer wall surface portion of the pressing member.

BRIEF DESCRIPTION OF THE DRAWINGS

Other objects, features and advantages of the present invention will become more apparent from the following description made with reference to the accompanying drawings, in which like parts are designated by like reference numbers and in which.

DETAILED DESCRIPTION

Figure 1:
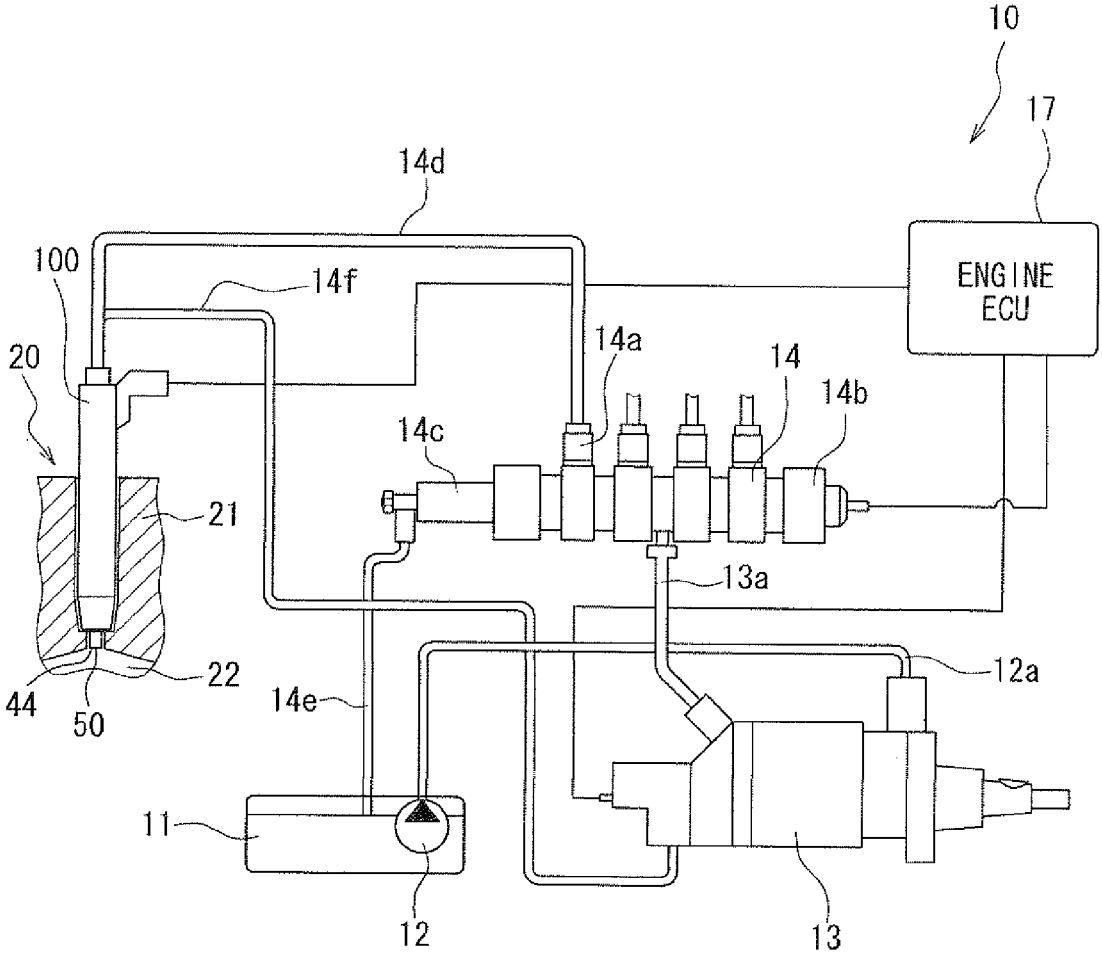
FIG. 1 is a schematic diagram of a fuel supply system having a fuel injection device according to embodiments of the present invention.

Embodiments for carrying out the present invention will be described hereafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

(First Embodiment)

A fuel supply system 10, in which a fuel injection device 100 according to a first embodiment of the present invention is used, is shown in FIG. 1. The fuel supply system 10 is a so-called direct injection fuel supply system in which fuel is directly injected into a combustion chamber 22 of a diesel engine 20 as an internal combustion engine.

The fuel supply system 10 is constructed of a feed pump 12, a high-pressure fuel pump 13, a common rail 14, an engine control device 17 (engine ECU), the fuel injection device 100, and the like.

The feed pump 12 is an electrically driven pump and is housed in a fuel tank 11. The feed pump 12 applies a feed pressure to fuel stored in the fuel tank 11, such that the feed pressure is higher than the vapor pressure of the fuel. The feed pump 12 is connected to the high-pressure fuel pump 13 with a fuel pipe 12*a* and supplies the liquid-state fuel, which has a predetermined feed pressure applied thereto, to the high-pressure fuel pump 13. The fuel pipe 12*a* has a pressure control valve (not shown) fitted thereto and the pressure of the fuel supplied to the high-pressure fuel pump 13 is held at a specified value by the pressure control valve in the fuel pipe 12*a*.

The high-pressure fuel pump 13 is attached to the diesel engine 20 and is driven by power from an output shaft of the diesel engine 20. The high-pressure fuel pump 13 is connected to the common rail 14 by a fuel pipe 13*a*, and further applies pressure to the fuel supplied by the feed pump 12 to supply the fuel to the common rail 14. In addition, the high-pressure fuel pump 13 has an electromagnetic valve (not shown) electrically connected to the engine control device 17. The electromagnetic valve is opened or closed by the engine control device 17, and thereby the pressure of the fuel supplied from the high-pressure fuel pump 13 to the common rail 14 is optimally controlled to a predetermined pressure.

The common rail 14 is a pipe-shaped member made of a metal material such as chromium molybdenum steel and has a plurality of branch parts 14*a*. The number of the plurality of branch parts 14*a* corresponds to the number of cylinders per bank of the diesel engine. Each of the branch parts 14*a* is connected to the fuel injection device 100 by a fuel pipe forming a supply channel 14*d*. The fuel injection device 100 and the high-pressure fuel pump 13 are connected to each other by a fuel pipe forming a return channel 14*f*. According to the above-mentioned construction, the common rail 14 temporarily stores the fuel supplied in a high-pressure state by the high-pressure fuel pump 13, and distributes the fuel to the plurality of fuel injection devices 100 with the pressure held in the high-pressure state through the supply channels 14*d*. In addition, the common rail 14 has a common rail sensor 14*b* provided at one end portion of both end portions in an axial direction, and has a pressure regulator 14*c* provided at the other end portion thereof. The common rail sensor 14*b* is electrically connected to the engine control device 17 and detects the pressure and the temperature of the fuel and outputs them to the engine control device 17. The pressure regulator 14*c* maintains the pressure of the fuel in the common rail 14 at a constant value, and decompresses and discharge excess fuel. The excess fuel passing through the pressure regulator 14*c* is returned to the fuel tank 11 through a channel in a fuel pipe 14*e* that connects the common rail 14 to the fuel tank 11.

The fuel injection device 100 is a device for injecting high-pressure supply fuel supplied through the branch part 14*a* of the common rail 14, from a nozzle hole 44. Specifically, the fuel injection device 100 has a valve portion 50 that controls the injection of the supply fuel injected from the nozzle hole 44 according to a control signal from the engine control device 17. The supply fuel is supplied from the high-pressure pump 13 through the supply channel 14*d*. In addition, in the fuel injection device 100, the excess fuel, which is a portion of the supply fuel supplied from the supply channel 14*d* and is not injected from the nozzle hole 44, is discharged into the return channel 14*f* through which the fuel injection device 100 communicates with the high-pressure fuel pump 13, and then is returned to the high-pressure fuel pump 13. The fuel injection device 100 is inserted into and fitted into an insertion hole made in a head member 21 that is a portion of the combustion chamber 22 of the diesel engine 20. In the present embodiment, a plurality of the fuel injection devices 100 are arranged for each combustion chamber 22 of the diesel engine 20 and each of them injects the fuel directly into the combustion chamber 22, specifically, with an injection pressure of a range from 160 to 220 megapascal (MPa).

The engine control device 17 is constructed of a microcomputer or the like. The engine control device 17 is electrically connected to not only the common rail sensor 14*b* described above but also various kinds of sensors such as a rotational speed sensor for detecting the rotational speed of the diesel engine 20, a throttle sensor for detecting a throttle opening, an air flow sensor for detecting an intake air volume, a boost pressure sensor for detecting a boost pressure, a water temperature sensor for detecting a cooling water temperature, and an oil temperature sensor for detecting the oil temperature of lubricating oil. The engine control device 17 outputs an electric signal for controlling the opening/closing of the electromagnetic valve of the high-pressure fuel pump 13 and the valve portion 50 of each fuel injection device 100, to the electromagnetic valve of the high-pressure fuel pump 13 and to each fuel injection device 100 on the basis of information from these respective sensors.

Figure 2:
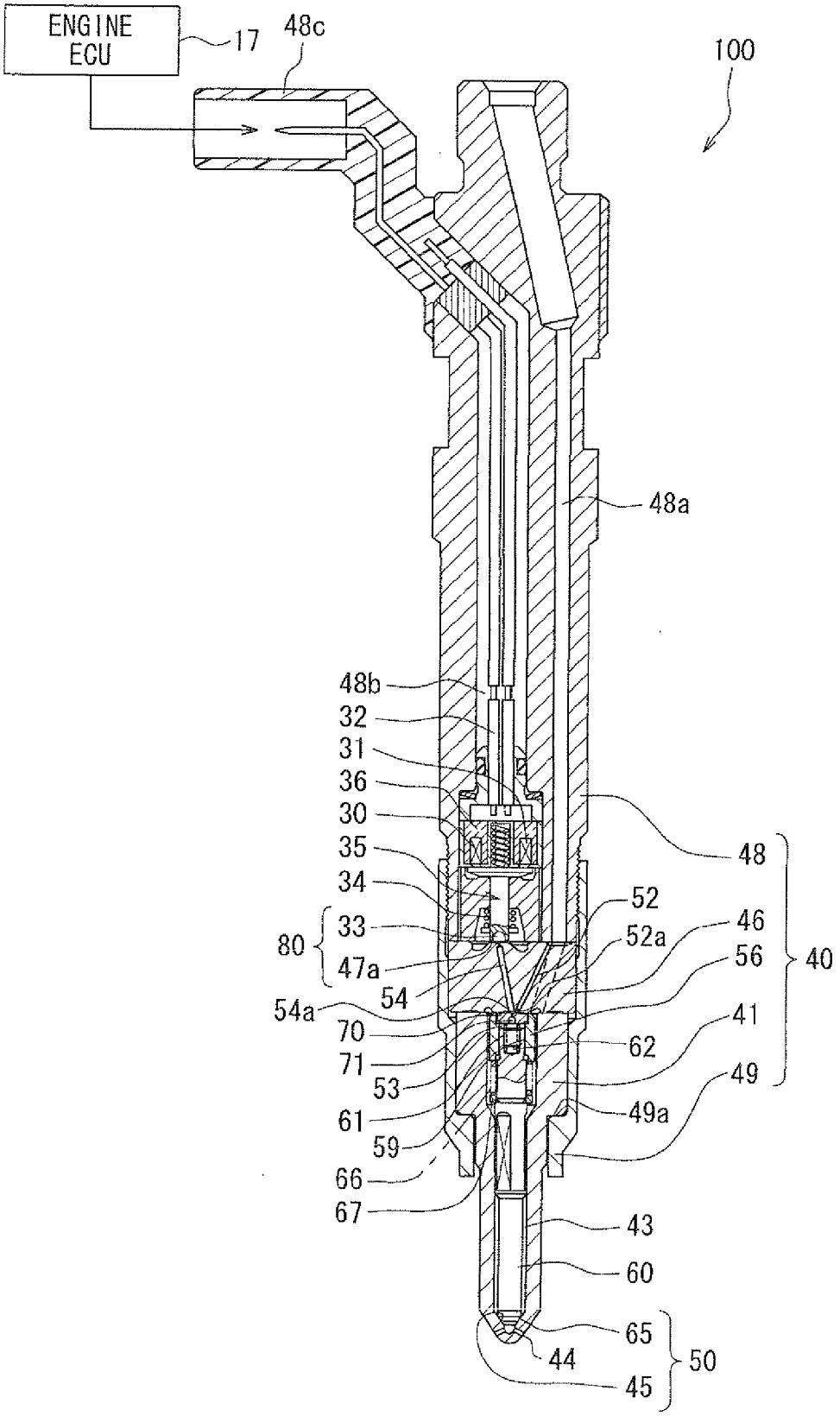
FIG. 2 is a longitudinal section view of the fuel injection device according to the embodiments of the present invention.
Figure 3:
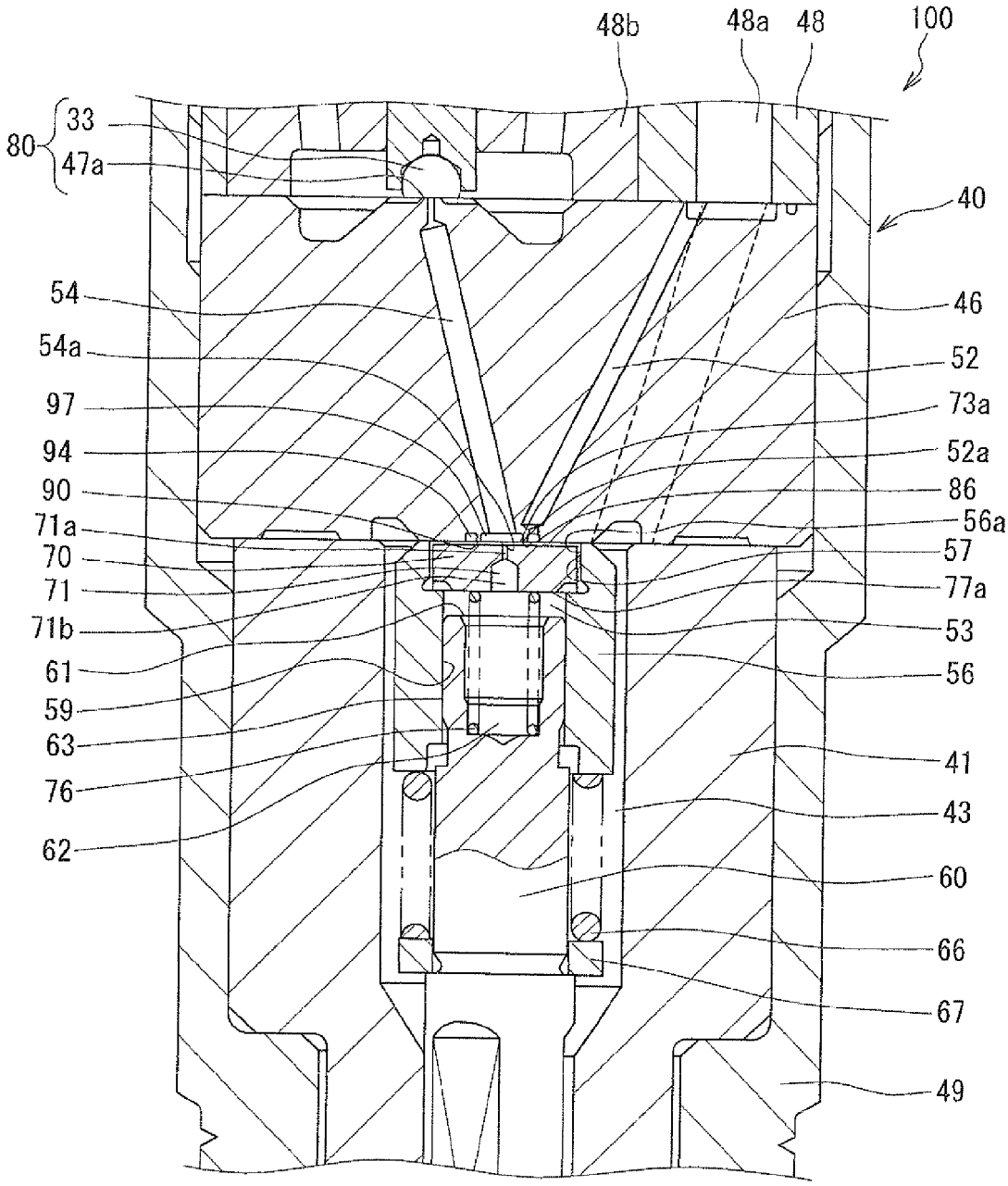
FIG. 3 is a partially enlarged sectional view showing a portion of a fuel injection device according to a first embodiment of the present invention.

Next, the structure of the fuel injection device 100 will be described in detail on the basis of FIGS. 2 to 4.

The fuel injection device 100 includes a control valve driving part 30, a control body 40, a nozzle needle 60, a spring 76, a floating plate 70, the valve portion 50 and the like.

The control valve driving part 30 is housed in the control body 40. The control valve driving part 30 includes a terminal 32, a solenoid 31, a fixed member 36, a movable member 35, a spring 34, and a valve seat member 33. The terminal 32 is formed of a metal material having electrical conductivity and has one end portion of both end portions in an extending direction exposed to the outside from the control body 40 and has the other end portion thereof connected to the solenoid 31. The solenoid 31 is spirally wound and is supplied with a pulse current from the engine control device 17 via the terminal 32. When the solenoid 31 is supplied with this current, the solenoid 31 generates a magnetic field circling along the axial direction. The fixed member 36 is a cylindrical member formed of a magnetic material and is magnetized in the magnetic field generated by the solenoid 31. The movable member 35 is a member formed of a magnetic material and in the shape of a cylinder having two steps and is arranged on a tip side in the axial direction of the fixed member 36. The movable member 35 is attracted to a base end side in the axial direction by the magnetized fixed member 36. The spring 34 is a coil spring made by winding a metal wire in the shape of a circle and biases the movable member 35 in a direction to separate the movable member 35 from the fixed member 36. The valve seat member 33 forms a pressure control valve 80 together with a control valve seat portion 47*a* of the control body 40. The control valve seat portion 47*a* will be described later. The valve seat member 33 is arranged on the opposite side of the fixed member 36 in the axial direction of the movable member 35, and is seated on the control valve seat portion 47*a*. When the magnetic field is not generated by the solenoid 31, the valve seat member 33 is seated on the control valve seat portion 47*a* by the biasing force of the spring 34. When the magnetic field is generated by the solenoid 31, the valve seat member 33 is separated from the control valve seat portion 47*a*.

The control body 40 has a nozzle body 41, a cylinder 56, a valve body 46, a holder 48, and a retaining nut 49. The nozzle body 41, the valve body 46, and the holder 48 are arranged in this order from a tip side in a direction in which they are inserted into the head member 21 having the nozzle hole 44 formed therein (see FIG. 1). The control body 40 has an inflow channel 52, an outflow channel 54, a pressure control chamber 53, an abutting surface 90 exposed to the pressure control chamber 53, and an inner wall surface 56*a*. The inflow channel 52 communicates with a side of the supply channel 14*d* (see FIG. 1) connected to the high-pressure fuel pump 13 and the common rail 14, and has an inflow port 52*a* opened at the abutting surface 90. The inflow port 52*a* is a channel end of the inflow channel 52. The outflow channel 54 communicates with a side of the return channel 14*f* (see FIG. 1) connected to the high-pressure fuel pump 13, and has an outflow port 54*a* opened at the abutting surface 90. The outflow port 54*a* is a channel end of the outflow channel 54. The pressure control chamber 53 is partitioned by the cylinder 56 and the like, and the fuel passing through the supply channel 14*d* (see FIG. 1) flows into the pressure control chamber 53 from the inflow port 52*a* and flows out of the pressure control chamber 53 to the return channel 14*f* (see FIG. 1) from the outflow port 54*a*.

The nozzle body 41 is a member made of a metal material such as chromium molybdenum steel or the like in the shape of a circular cylinder and closed at one end. The nozzle body 41 has a nozzle needle housing portion 43, a valve seat portion 45, and the nozzle hole 44. The nozzle needle housing portion 43 is formed along the axial direction of the nozzle body 41, and is a cylindrical hole in which a nozzle needle 60 is housed. The nozzle needle housing portion 43 has high-pressure fuel that is supplied from the high-pressure fuel pump 13 and the common rail 14 (see FIG. 1). The valve seat portion 45 is formed on the bottom wall of the nozzle needle housing portion 43 and is brought into contact with the tip end of the nozzle needle 60. The nozzle hole 44 is located on the opposite side of the valve body 46 with respect to the valve seat portion 45. A plurality of the nozzle holes 44 are formed radially from the inside of the nozzle body 41 to the outside thereof. When the high-pressure fuel passes through the nozzle holes 44, the high-pressure fuel is atomized and diffused, thereby being brought into a state where the fuel is easily mixed with air.

The cylinder 56 made of a metal material forms a cylindrical wall portion that is formed in the shape of a circular cylinder and that defines the pressure control chamber 53 together with the valve body 46 and the nozzle needle 60. The cylinder 56 is a member made of a metal material in the shape of a circular cylinder, and is arranged coaxially with the nozzle needle housing portion 43 within the nozzle needle housing portion 43. In the cylinder 56, an end surface located on a side of the valve body 46 in the axial direction is held by the valve body 46. The inner wall surface 56*a* of the cylinder 56 is provided with a control wall surface portion 57 and a cylinder sliding surface portion 59. A step portion is formed between the control wall surface portion 57 and the cylinder sliding surface portion 59. The control wall surface portion 57 is positioned on a side of the valve body 46 in an axial direction of the cylinder 56, and circularly encloses the abutting surface 90 to define the pressure control chamber 53. The cylinder sliding surface portion 59 is positioned opposite to the valve body 46 in the axial direction of the cylinder 56, such that the nozzle needle 60 is slidable on the cylinder sliding surface portion 90 along the axial direction. The inner diameter of the cylinder sliding surface portion 59 is reduced with respect to the inner diameter of the control wall surface portion 57, so that the step portion used as a plate stopper surface portion is formed between the control wall surface portion 57 and the cylinder sliding surface portion 59.

The valve body 46 is a member made of a metal material such as chromium molybdenum steel in the shape of a circular column, and is held between the nozzle body 41 and the holder 48. The valve body 46 has a control valve seat portion 47*a*, the abutting surface 90, the outflow channel 54, and the inflow channel 52, as shown in FIG. 3. The control valve seat portion 47*a* is formed on one end surface of the both end surfaces on a side of the holder 48 in the axial direction of the valve body 46, and constructs the pressure control valve 80 together with the valve seat member 33 of the control valve driving part 30 and the like. The abutting surface 90 is formed in a central portion in the radial direction of an end surface of the valve body 46 on a side of the nozzle body 41. The abutting surface 90 is surrounded by the cylindrical cylinder 56 and is formed in a circular shape. The outflow channel 54 is extended toward the control valve seat portion 47*a* from a central portion in the radial direction of the abutting surface 90. The outflow channel 54 is inclined with respect to the axial direction of the valve body 46. The inflow channel 52 is extended toward an end surface forming the control valve seat portion 47*a* from the outside in the radial direction of the outflow channel 54 in the abutting surface 90. The inflow channel 52 is inclined with respect to the axial direction of the valve body 46.

The valve body 46 has an outflow depressed portion 97 that is depressed from the abutting surface 90 and that forms the outflow port 54*a*. The valve body 46 has an inflow depressed portion 94 that is depressed from the abutting surface 90 and that forms the inflow port 52*a*. The outflow depressed portion 97 is depressed in the shape of a circle in the central portion, in the radial direction of the abutting surface 90. The inflow depressed portion 94 is located outside in the radial direction of the outflow depressed portion 97 in the abutting surface 90, and is depressed concentrically with the outflow depressed portion 97 and in the shape of a circular ring. The outflow depressed portion 97 and the inflow depressed portion 94 are provided to be independent of each other, and are not connected to each other.

The holder 48 is a member made of a metal material such as chromium molybdenum steel in the shape of a cylinder, and has longitudinal holes 48*a*, 48*b* formed along the axial direction and has a socket portion 48*c*. The longitudinal hole 48*a* is a fuel channel that makes the supply channel 14*d* (see FIG. 1) communicate with the inflow channel 52. On the other hand, the longitudinal hole 48*b* has therein the control valve driving part 30 on a side of the valve body 46. In addition, in the longitudinal hole 48*b*, the socket portion 48*c* is formed at a portion on the opposite side of the valve body 46, in such a way as to close the opening of the longitudinal hole 48*b*. The socket portion 48*c* has one end of the terminal 32 of the control valve driving part 30 projected thereinto and has a plug portion (not shown) detachably fitted therein. The plug portion is connected to the engine control device 17. When the socket portion 48*c* is connected to the plug portion (not shown), a pulse current can be supplied to the control valve driving part 30 from the engine control device 17.

The retaining nut 49 is a member made of a metal material in the shape of a circular cylinder having two steps. The retaining nut 49 houses a portion of the nozzle body 41 and the valve body 46, and is screwed with a portion of the holder 48 on a side of the valve body 46. In addition, the retaining nut 49 has a stepped portion 49*a* on the inner peripheral wall portion thereof. When the retaining nut 49 is fitted to the holder 48, the stepped portion 49*a* presses the nozzle body 41 and the valve body 46 toward the holder 48. In this manner, the retaining nut 49 holds the nozzle body 41 and the valve body 46, together with the holder 48.

The nozzle needle 60 is formed of a metal material such as high-speed tool steel in the shape of a circular column as a whole, and has a seat portion 65, a pressure receiving surface 61, a spring housing portion 62, a needle sliding portion 63, and a collar member 67. The seat portion 65 is formed on an end portion, which is one of both end portions in the axial direction of the nozzle needle 60 and is arranged opposite to the pressure control chamber 53, and is seated on the valve seat portion 45 of the control body 40. The seat portion 65 constructs a valve portion 50 together with the valve seat portion 45, such that the valve portion 50 allows and interrupts the flow of the high-pressure fuel supplied into the nozzle needle housing portion 43 to the nozzle holes 44. The pressure receiving surface 61 is formed of an end portion, which is one of both end portions in the axial direction of the nozzle needle 60, and is arranged at a side of the pressure control chamber 53, opposite to the seat portion 65. The pressure receiving surface 61 partitions the pressure control chamber 53 together with the abutting surface 90 and the control wall surface portion 57, and receives the pressure of the fuel in the pressure control chamber 53. The spring housing portion 62 is a cylindrical hole formed coaxially with the nozzle needle 60 in the central portion in the radial direction of the pressure receiving surface 61. The spring housing portion 62 houses a portion of a spring 76. The needle sliding portion 63 is a portion of the circular column-shaped outer peripheral wall of the nozzle needle 60 and is located closer to the pressure receiving surface 61 than the control wall surface portion 57. The needle sliding portion 63 is supported in such a way as to freely slide with respect to the cylinder sliding surface portion 59 formed by the inner peripheral wall of the cylinder 56. The collar member 67 is a ring-shaped member fitted on the outer peripheral wall portion of the nozzle needle 60 and is held by the nozzle needle 60.

The nozzle needle 60 is biased to a side of the valve portion 50 by a return spring 66. The return spring 66 is a coil spring made by winding a metal wire in the shape of a circle. The return spring 66 has one end in the axial direction seated on a face on the pressure control chamber 53 side of the collar member 67 and has the other end seated on an end surface on the valve portion side of the cylinder 56, respectively. According to the construction described above, the nozzle needle 60 is reciprocally displaced in a linear manner in the axial direction of the cylinder 56 with respect to the cylinder 56 in response to the pressure applied to the pressure receiving surface 61, that is, the pressure of the fuel in the pressure control chamber 53 to seat the seat portion 65 on the valve seat portion 45 or to separate the seat portion 65 from the valve seat portion 45, thereby closing or opening the valve portion 50.

The floating plate 70 is a pressing member made of a metal material in the shape of a circular disk, and is provided with an outer wall surface 70*a* that includes a pressing surface portion 73 and an outer peripheral wall surface portion 72. The floating plate 70 is arranged in such a way to be reciprocally displaced in the pressure control chamber 53 and has its displacement axis direction arranged along the axial direction of the cylinder 56. In addition, the floating plate 70 is arranged coaxially with the cylinder 56 to be displaced in the axial direction. Of both end surfaces 73*a*, 77*a* in a displacement axis direction of the floating plate 70, the end surface 73*a* opposite to the abutting surface 90 in the displacement axis direction forms the pressing surface portion 73. When the floating plate 70 is reciprocally displaced, the pressing surface portion 73 abuts on the abutting surface 90. The other axial end surface 77*a* of the floating plate 70, opposite to the pressing surface portion 73, is adapted as a pressure receiving surface that is opposite to the pressure receiving surface 61 of the nozzle needle 60 in the axial direction. One end of a spring 76 is held in the end surface 77*a* adapted as the pressure receiving surface to which the pressure of the fuel in the pressure control chamber 53 is applied. The outer peripheral wall surface portion 72 of the floating plate 70 is provided in a cylindrical shape to connect the pressing surface portion 73 and the pressure receiving surface 77*a* that are positioned at two end sides of the floating plate 70 in the axial direction. The outer peripheral wall surface portion 72 is formed into a cylindrical shape extending along the displacement axis direction of the floating plate 70. In a state where the floating plate 70 is placed coaxially with respect to the cylinder 56, the outer peripheral wall surface portion 72 of the floating plate 70 is opposite to the control wall surface portion 57 in a radial direction perpendicular to the displacement axis direction, while having a clearance therebetween so that the fuel can flow in the clearance therebetween. The fuel flowing into a space of the pressure control chamber 53 between the pressing surface portion 73 of the floating plate 70 and the abutting surface 90, flows into a space of the pressure control chamber 53 between the pressure receiving surface 77*a* of the floating plate 70 and the pressure receiving surface 61, via the clearance between the outer peripheral wall surface portion 72 and the control wall surface portion 57.

The communication hole 71 is extended from the central portion of the pressing surface portion 73, along the displacement axis direction of the floating plate 70. When the pressing surface portion 73 of the floating plate 70 abuts on the abutting surface 90, the communication hole 71 becomes a fuel channel that makes the pressure control chamber 53 communicate with the outflow channel 54. The communication hole 71 has a narrowed portion 71*a* (throttle portion) and a communication depressed portion 71*b*. The narrowed portion 71*a* narrows the channel area of the communication hole 71 to regulate the flow amount of the fuel flowing through the communication hole 71. The narrowed portion 71*a* is closer to the end surface 73*a*, which is one of both end surfaces 73*a*, 77*a* in the axial direction of the floating plate 70 and forms the pressing surface portion 73, than the end surface 77*a* opposite to the pressure receiving surface 61. In the communication depressed portion 71*b*, of a pair of openings of the communication hole 71, one opening formed in the end surface 77*a* is made large. On the other hand, the end surface 77*a* opposite to the pressing surface portion 73 in the displacement axis direction is biased by the spring 76.

The spring 76 is a coil spring made by winding a metal wire in the shape of a circle. The spring 76 has one end in the axial direction seated on the end surface 77*a* of the floating plate 70. The spring 76 has the other end in the axial direction housed in the spring housing portion 62 of the nozzle needle 60. The spring 76 is arranged between the floating plate 70 and the nozzle needle 60 coaxially with them and is arranged in a contracted state in the axial direction.

According to the construction described above, the spring 76 biases the floating plate 70 to the side of the abutting surface 90 with respect to the nozzle needle 60. Even when a pressure difference between both the end surface 73*a* and the end surface 77*a* of the floating plate 70 in the displacement axis direction of the floating plate 70 is small, the floating plate 70 is biased to the abutting surface 90 by the biasing force of the spring 76 to make the pressing surface portion 73 abut on the abutting surface 90.

Figure 4:
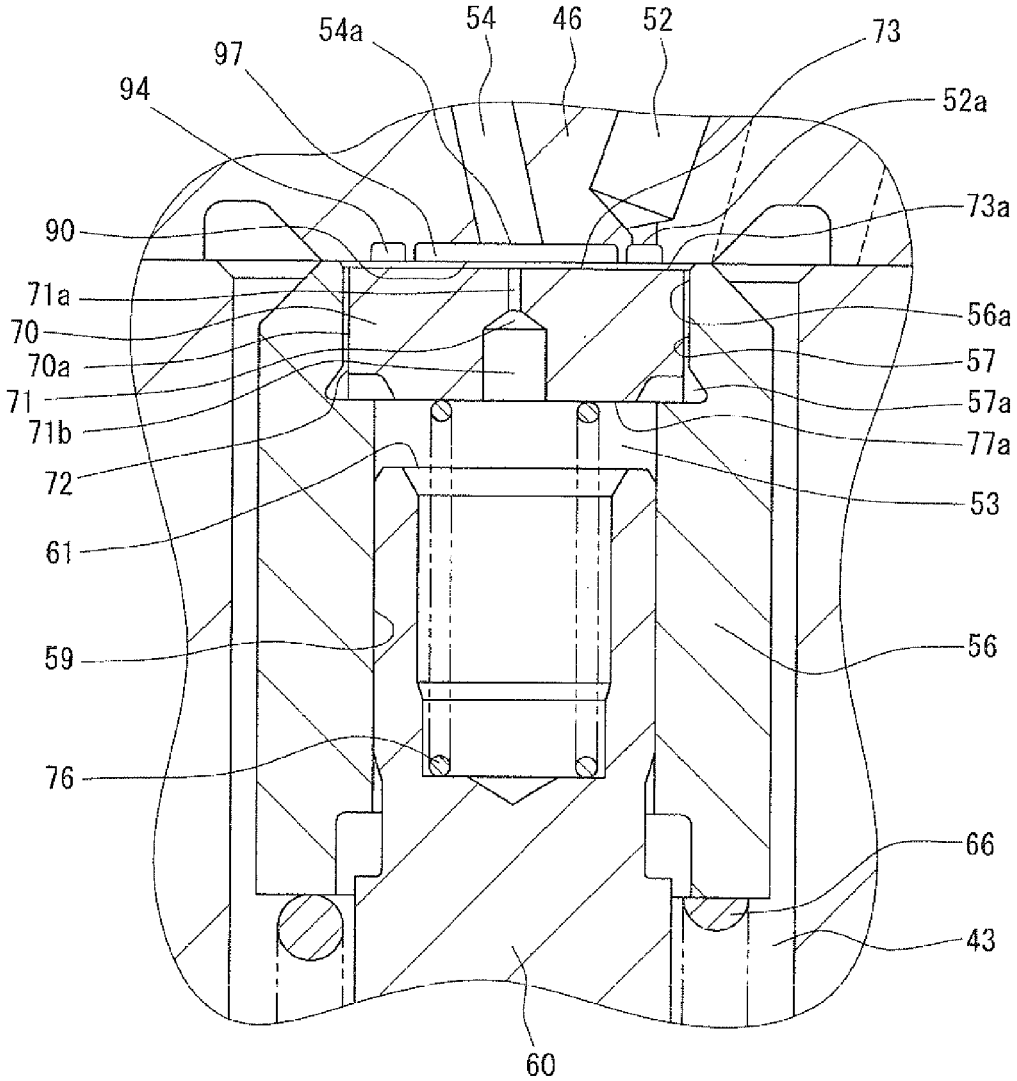
FIG. 4 is a further enlarged sectional view showing the portion of the fuel injection device according to the first embodiment of the present invention.

Next, the fuel injection device 100 will be further described in detail on the basis of FIG. 4.

The control wall surface portion 57 provided in the inner wall surface 56*a* of the cylinder 56 is opposite to the outer peripheral wall surface portion 72 in a radial direction, at any position of the floating plate 70 displaced in the displacement axis direction. If the floating plate 70 is shifted to a direction perpendicular to the displacement axis direction, the outer peripheral wall surface portion 72 will contact the control wall surface portion 57. In the present embodiment, a recess portion 57*a* is formed in the control wall surface portion 57 to be recessed radially outside, thereby being separated from the outer peripheral wall surface portion 72. The recess portion 57*a* is formed into a circular ring shape that is symmetrical with respect to the displacement axis direction of the floating plate 70 and the axial direction of the cylinder 56. The recess portion 57*a* is formed at a position of the control wall surface portion 57, most adjacent to the cylinder sliding surface portion 59 in the axial direction.

Next, operation of the fuel injection device 100 will be described below on the basis of FIG. 2 to FIG. 4.

The magnetic field generated by the solenoid 31 in response to the pulse current of the engine control device 17 opens the pressure control valve 80. The operation of the pressure control valve 80 makes the outflow port 54*a* communicate with the return channel 14*f*, so that the fuel flows out of the pressure control chamber 53 through the outflow channel 54 and the longitudinal hole 48*b*. Thus, firstly, pressure near the outflow port 54*a* can be reduced in the pressure control chamber 53, whereby the floating plate 70 is drawn toward the abutting surface 90, and the floating plate 70 receives pressure applied to the end surface 77*a* by the fuel in the pressure control chamber 53. In addition, the floating plate 70 receives the biasing force of the spring 76 applied thereto from the end surface 77*a* side. The reduction in pressure near the outflow port 54*a* and the biasing force of the spring 76 more strongly presses the pressing surface portion 73 abutting on the abutting surface 90 of the valve body 46 onto the abutting surface 90. When the pressing surface portion 73 of the floating plate 70 presses the abutting surface 90 in this manner, the communication between the inflow port 52*a* opened in the abutting surface 90 and the pressure control chamber 53 is interrupted. Then, in the pressure control chamber 53 in which the inflow of the fuel from the inflow port 52*a* is interrupted, a rapid reduction in pressure is caused by the outflow of the fuel passing through the communication hole 71.

The rapid reduction in pressure in the pressure control chamber 53 makes the force that the seat portion 65 and the like mainly receives from the fuel in the nozzle needle housing portion 43 larger than the total of the force that the pressure receiving surface 61 receives from the fuel in the pressure control chamber 53 and the biasing force of the return spring 66. Thus, the nozzle needle 60 having this difference in the force applied thereto is pressed up to the side of the pressure control chamber 53 at a high speed. The nozzle needle 60 displaced to the side of the pressure control chamber 53 causes the seat portion 65 to be separated from the valve seat portion 45, to bring the valve portion 50 into an open state.

When the magnetic field generated by the solenoid 31 in response to the pulse current of the engine control device 17 is destroyed, the pressure control valve 80 is closed. Thus, the communication between the outflow port 54*a* and the return channel 14*f* is interrupted, thereby stopping the outflow of the fuel through the outflow channel 54 and the longitudinal hole 48*b*. When the fuel passing through the communication hole 71 flows into the outflow depressed portion 97, the force that is applied to the floating plate 70 to press the pressing surface portion 73 onto the abutting surface 90 is mainly the biasing force by the spring 76. Then, the floating plate 70 is pressed down toward the nozzle needle 60 by the pressure of the high-pressure fuel filled in the inflow depressed portion 94, and begins to displace.

According to the first embodiment, the recess portion 57*a* is formed in the control wall surface portion 57 of the cylinder 56 such that the fuel in the pressure control chamber 53 can be held in the recess portion 57*a*. Therefore, the outer peripheral wall surface portion 72 of the floating plate 70 is pressed in a direction separating from the control wall surface portion 57, by the force due to the fuel held in the recess portion 57*a*. Thus, it is possible to effectively reduce attracting force caused between the outer peripheral wall surface portion 72 of the floating plate 70 and the control wall surface portion 57 of the cylinder 56. Furthermore, because the recess portion 57*a* is formed in the control wall surface portion 57, a contact area between the control wall surface portion 57 and the outer peripheral wall surface portion 72 can be reduced, thereby further reducing attracting force caused between the control wall surface portion 57 and the outer peripheral wall surface portion 72. Thus, the floating plate 70 can be smoothly moved, because the attracting force of the outer peripheral wall surface portion 72 with respect to the control wall surface portion 57 is reduced.

Because the floating plate 70 can be smoothly displaced toward the side of the nozzle needle 60, the inlet port 52*a* can be rapidly opened to the pressure control chamber 53. Thus, the fuel introduction from the inflow channel 52 is re-started. The fuel flowing into the pressure control chamber 53 from the inflow channel 52 passes through the clearance between the outer peripheral wall surface portion 72 of the floating plate 70 and the control wall surface portion 57 of the cylinder 56, to rapidly increase the pressure in the pressure control chamber 53. A rapid increase in the pressure of the pressure control chamber 53 again makes the total of the receiving force of the pressure receiving surface 61 received from the fuel in the pressure control chamber 53, and the biasing force of the return spring 66, to be larger than the receiving force of the seat portion 65 and the like mainly received from the fuel in the nozzle needle housing portion 43. Thus, the nozzle needle 60 is pressed down toward the valve portion 50 at a high speed. Then, the seat portion 65 of the nozzle needle 60 seats on the valve seat portion 45 to bring the valve portion 50 into a closed state.

Thus, a pressure difference between two sides (i.e., the side of the abutting surface 90 and the side of the pressure receiving surface 61) of the floating plate 70 in the pressure control chamber 53 can be gradually reduced. Then, the floating plate 70 tends to displace toward the abutting surface 90, by the biasing force of the spring 76. At this time, because the attracting force caused between the control wall surface portion 57 and the outer peripheral wall surface portion 72 of the floating plate 70 is reduced by the fuel in the recess portion 57*a*, the floating plate 70 can be smoothly moved toward the abutting surface 90. Then, the pressing surface portion 73 of the floating plate 70 abuts on the abutting surface 90.

According to the first embodiment, because the recess portion 57*a* is formed in the control wall surface portion 57 of the cylinder 56, the attracting force between the control wall surface portion 57 and the outer peripheral wall surface portion 72 can be reduced by the recess portion 57*a*, and thereby the floating plate 70 can be displaced reciprocally and smoothly in the pressure control chamber 53. Thus, the response of the floating plate 70 can be improved, with respect to the switch operation of the pressure control valve 80 between the communication of the outflow port 54*a* and the return channel 14*f*, and the interruption of the communication.

Furthermore, according to the first embodiment, if the displacement axis direction of the floating plate 70 is shifted from the axial direction of the cylindrical control wall surface portion 57, the outer peripheral wall surface portion 72 of the floating plate 70 is pressed by the fuel in the recess portion 57*a*, thereby correcting the shifted position of the floating plate 70. Furthermore, it can restrict a contact between the control wall surface portion 57 and the outer peripheral wall surface portion 72 by using the fuel held in the recess portion 57*a*, thereby reducing the attracting force of the outer wall surface 70*a* of the floating plate 70 to the inner wall surface 56*a* of the cylinder 56.

The recess portion 57*a* is formed into a circular ring shape symmetrical with respective to the center point, such that the force due to the fuel in the recess portion 57*a* is equally applied to the outer peripheral wall surface portion 72 of the floating plate 70. Thus, it can prevent the displacement axis direction of the floating plate 70 as a pressing member from being shifted. Furthermore, even when a shift of the displacement axis direction of the floating plate 70 is caused, the shift can be easily corrected. Accordingly, the displacement axis direction of the floating plate 70 can be easily corrected to be coaxially with the cylinder 56, by using the fuel in the recess portion 57*a*. Therefore, it can accurately prevent the outer peripheral wall surface portion 72 of the floating plate 70 from attracting to the control wall surface portion 57, and thereby the floating plate 70 can be displaced and reciprocated smoothly in the pressure control chamber 53. As a result, the response of the floating plate 70 with respect to the switching operation of the pressure control valve 80 can be more effectively improved.

In the present embodiment, a force is applied to the floating plate 70 in the displacement axis direction of the floating plate 70, due to the fuel passing through the communication hole 71 extending in the displacement axis direction of the floating plate 70. Furthermore, because the communication hole 71 is placed at the radial center portion of the end surface 73*a*, the force due to the fuel passing through the communication hole 71 is applied to the center portion in the radial direction of the end surface 73*a*. Thus, the force due to the fuel passing through the communication hole 71 does not cause a shift of the displacement axis direction of the floating plate 70 from the axial direction of the cylinder 56. As a result, the floating plate 70 can be smoothly displaced.

In the present embodiment, the valve body 46 having the abutting surface 90 is formed separately from the cylinder 56 having the control wall surface portion 57 formed by the inner wall surface 56*a*. Therefore, the recess portion 57*a* can be easily formed in the control wall surface portion 57 of the cylinder 56. The inner wall surface 56*a* of the cylinder 56 is provided with the control wall surface portion 57 and the cylinder sliding surface portion 59, such that the inner diameter of the control wall surface portion 57 is larger than the inner diameter of the cylinder sliding surface portion 59. Therefore, a step portion is formed between the control wall surface portion 57 and the cylinder sliding surface portion 59. In this case, if the valve body 46 is formed integrally with the cylinder 56, it is difficult to form the recess portion 57*a*. In contrast, in the present embodiment, the cylinder 56 having the recess portion 57*a* is a member different from the valve body 46, and the cylinder 56 having the recess portion 57*a* is assembled to the valve body 46. Therefore, the recess portion 57*a* can be easily formed in the control body 40.

In the first embodiment, the valve body 46 is an example of a valve body member, the cylinder 56 is an example of a cylindrical member, the nozzle needle 60 is an example of a valve member, and the floating plate 70 is an example of a pressing member. Furthermore, the outer peripheral surface portion 72 is an example of an outer wall surface portion of the floating plate 70, which is capable of contacting the control wall surface portion 57.

(Second Embodiment)

Figure 5:
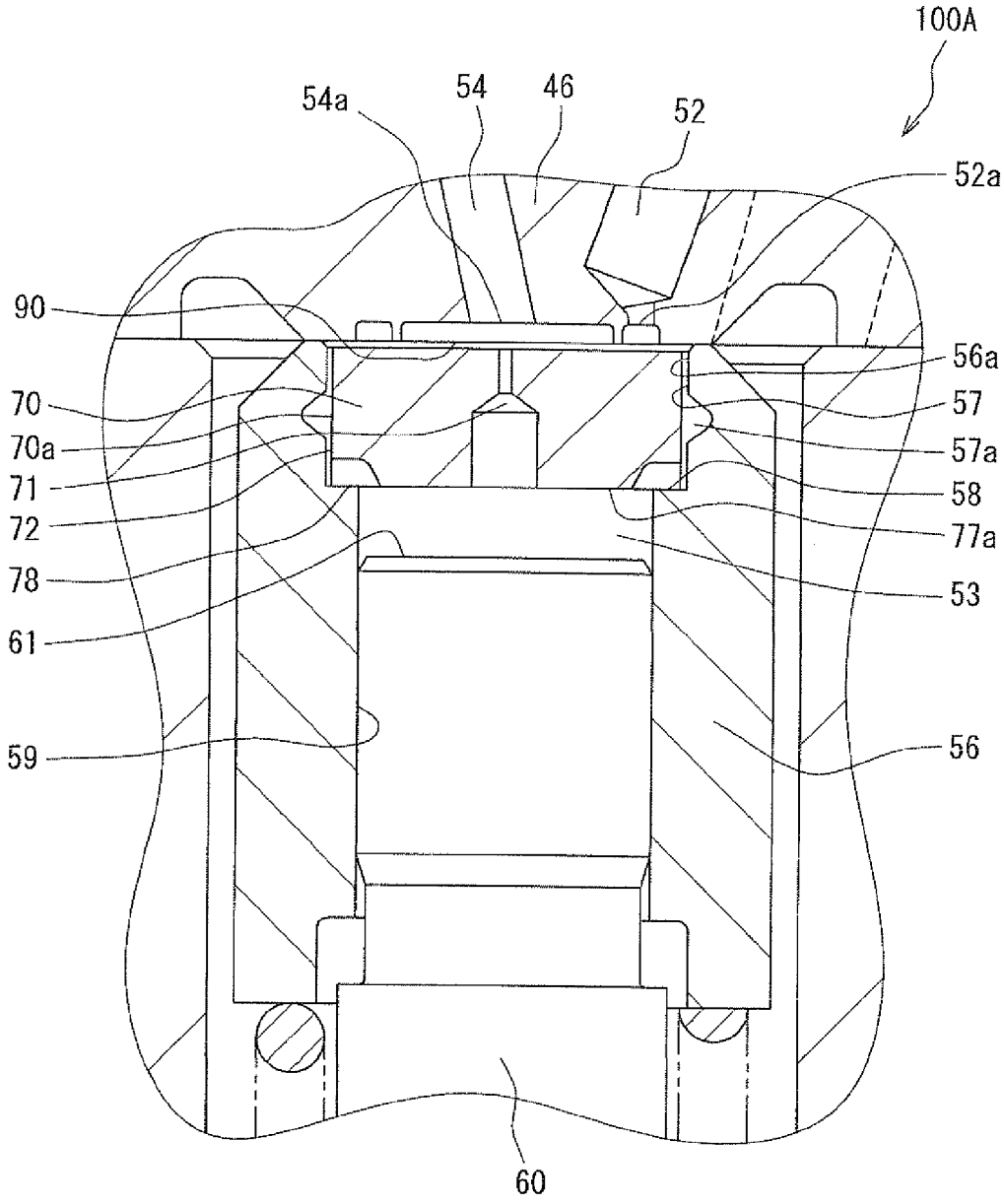
FIG. 5 is a sectional view to show a modification example of FIG. 4, according to a second embodiment of the present invention.

A second embodiment of the present invention will be described with reference to FIGS. 1, 2 and 5 The second embodiment shown in FIG. 5 is a modification example of the above-described first embodiment. A fuel injection device 100A of the second embodiment includes a nozzle needle 60, a valve body 46, a cylinder 56 and a floating plate 70. In addition, in the fuel injection device 100A, a construction corresponding to the spring 76 in the above-described first embodiment is omitted. Hereinafter, the construction of the fuel injection device 100A according to the second embodiment will be described in detail.

A plate stopper surface portion 58 is formed in the cylinder 56 at the inner wall surface 56*a*, between the control wall surface portion 57 and the cylinder sliding surface portion 59. That is, the plate stopper surface portion 58 is formed at the step portion between the control wall surface portion 57 and the cylinder sliding surface portion 59, in a circular ring shape. The plate stopper surface portion 58 is a flat surface parallel to the end surface 77*a* of the floating plate 70. The plate stopper surface portion 58 is configured to regulate the displacement of the floating plate 70 in the direction approaching the nozzle needle 60.

In the present embodiment, a recess portion 57*a* is formed in the control wall surface portion 57 to be recessed radially outside, thereby being separated from the outer peripheral wall surface portion 72. The recess portion 57*a* is formed into a circular shape that is symmetrical with respect to the displacement axis direction of the floating plate 70 and a center axis of the cylinder 56. In the second embodiment, the recess portion 57*a* is positioned in the control wall surface portion 57 approximately at a center portion in the axial direction.

The end surface 77*a* of the floating plate 70, opposite to the pressure receiving surface 61, is provided with a contact surface portion 78 at an outer periphery of the end surface 77*a*. The contact surface portion 78 is formed into a circular ring shape to opposite to the plate stopper surface portion 58. When the floating plate 70 is displaced to the direction separated from the abutting surface 90, the contact surface portion 78 of the floating plate 70 contacts the plate stopper surface portion 58 of the cylinder 56, thereby regulating the displacement of the floating plate 70 on a side of the pressure receiving surface 61.

Next, the operation for opening and closing the valve portion 50 in the above-described fuel injection device 100A will be described with reference to FIGS. 1, 2 and 5.

Before the outflow port 54*a* is made to communicate with the return channel 14*f* by the operation of the pressure control valve 80, the contact surface portion 78 of the floating plate 70 is seated on the plate stopper surface portion 58. When the operation of the pressure control valve 80 makes the outflow port 54*a* communicate with the return channel 14*f*, the fuel flows out of the pressure control chamber 53 through the outflow channel 54. Due to the decompression around the outflow port 54*a*, the floating plate 70 is drawn toward the abutting surface 90, and thereby the contact surface portion 78 displaces in the direction separating from the plate stopper surface portion 58.

According to the second embodiment, the recess portion 57*a* is formed in the control wall surface portion 57 of the cylinder 56 such that the fuel in the pressure control chamber 53 is held in the recess portion 57*a*. Therefore, by using the force from the fuel held in the recess portion 57*a*, the outer peripheral wall surface portion 72 is pressed to the direction separating from the control wall surface portion 57. At this time, because the attracting force caused between the control wall surface portion 57 of the cylinder 56 and the outer peripheral wall surface portion 72 of the floating plate 70 is reduced by the fuel in the recess portion 57*a*, the floating plate 70 can be smoothly moved toward the abutting surface 90.

When the floating plate 70 contacts and presses the abutting surface 90, the communication between the inflow port 52*a* opened in the abutting surface 90 and the pressure control chamber 53 is interrupted. Then, in the pressure control chamber 53 in which the inflow of the fuel from the inflow port 52*a* is interrupted, a rapid reduction in pressure is caused by the outflow of the fuel passing through the communication hole 71. When the pressure in the pressure control chamber 53 is equal to or lower than the predetermined pressure, the nozzle needle 60 is moved upwardly toward the pressure control chamber 53, so that the seat portion 65 is separated from the valve seat portion 45 and the valve portion 50 is opened.

When the communication between the outflow port 54*a* and the return channel 14*f* is interrupted by the pressure control valve 80, the floating plate 70 is pressed toward the pressure receiving portion 61 of the nozzle needle 60 by the fuel flowing from the inflow port 52*a*, and starts displacing. At this time, because the attracting force caused between the control wall surface portion 57 and the outer peripheral wall surface portion 72 of the floating plate 70 is reduced by the fuel in the recess portion 57*a*, the floating plate 70 can be smoothly moved toward the pressure receiving surface 61. Then, the contact surface portion 78 of the floating plate 70 abuts on the plate stopper surface portion 58.

Because the floating plate 70 can be smoothly displaced toward the side of the nozzle needle 60, the inlet port 52*a* can be rapidly opened to the pressure control chamber 53. The fuel flowing into the pressure control chamber 53 from the inflow channel 52 passes through the clearance between the outer peripheral wall surface portion 72 of the floating plate 70 and the control wall surface portion 57 of the cylinder 56, to rapidly increase the pressure in the pressure control chamber 53. Then, the seat portion 65 of the nozzle needle 60 seats on the valve seat portion 45 to bring the valve portion 50 into a closed state.

In the second embodiment, the recess portion 57*a* is positioned in the control wall surface portion 57 at the center portion in the axial direction. However, the position of the recess portion 57*a* can be changed in the axial direction, without being limited to the example described above. Even in this case, the attracting force between the control wall surface portion 57 of the cylinder 56 and the outer peripheral wall surface portion 72 of the floating plate 70 can be effectively reduced. Thus, the floating plate 70 can be displaced and reciprocated smoothly in the pressure control chamber 53, and thereby the response of the floating plate 70 with respect to the switching operation of the pressure control valve 80 can be improved.

In the second embodiment, even when a biasing member for biasing the floating plate 70 toward the abutting surface 90 is not provided, the response of the floating plate 70 can be improved by using the recess portion 57*a*.

In the second embodiment, the other parts are similar to those of the above-described first embodiment.

(Third Embodiment)

A third embodiment of the present invention will be described with reference to FIGS. 1, 2 and 6.

Figure 6:
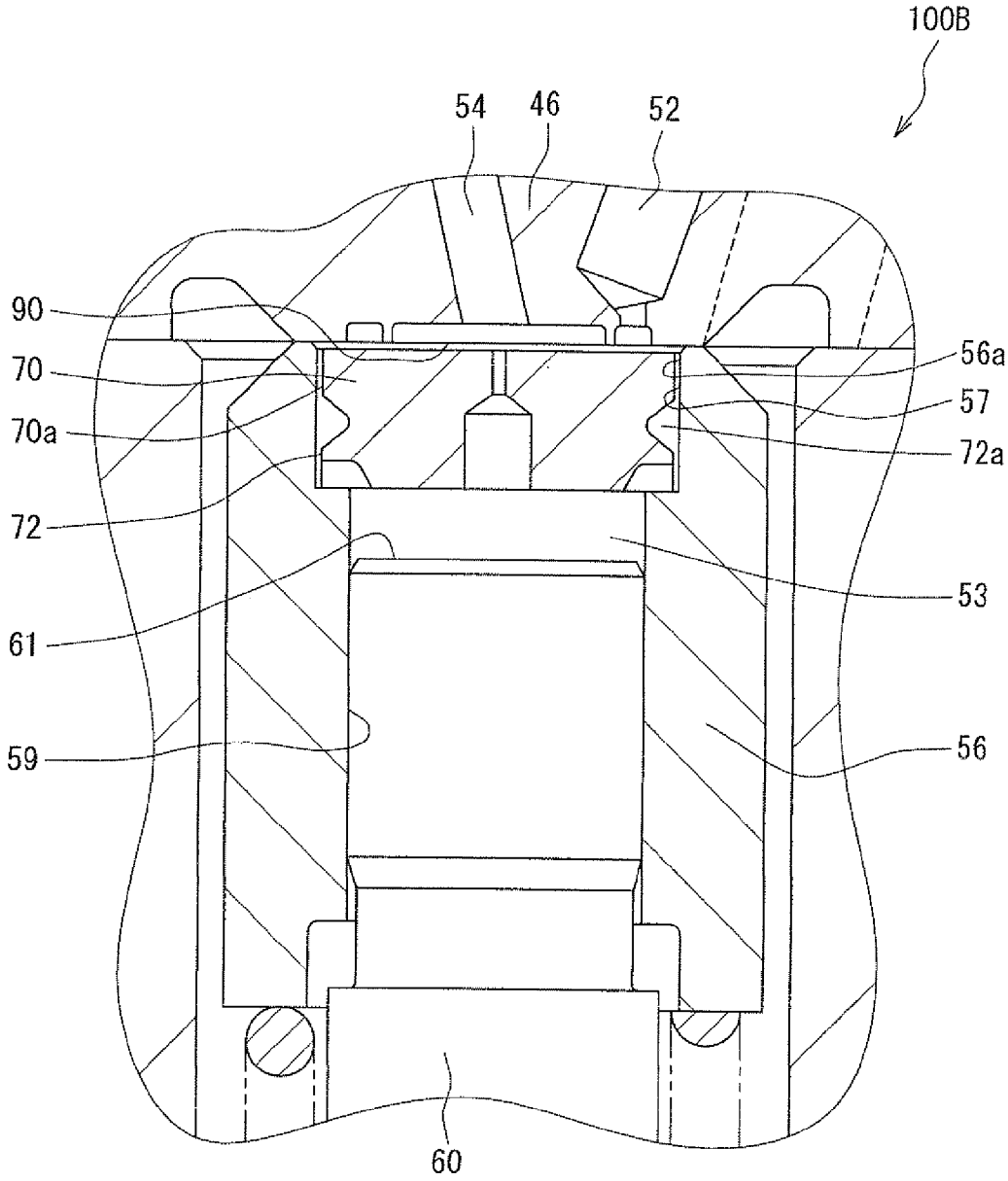
FIG. 6 is a sectional view to show a modification example of FIG. 5, according to a third embodiment of the present invention.

The third embodiment shown in FIG. 6 is a modification example of the above-described second embodiment. A fuel injection device 100B of the third embodiment includes a nozzle needle 60, a valve body 46, a cylinder 56 and a floating plate 70. In the present embodiment, a recess portion 72*a* is formed in the outer peripheral wall surface portion 72 of the floating plate 70 to be recessed radially inside, thereby being separated from a control wall surface portion 57 of the cylinder 56. Hereinafter, the construction of the fuel injection device 100B according to the third embodiment will be described in detail.

The inner wall surface 56*a* of the cylinder 56 is not provided with a recess portion, such that the control wall surface portion 57 of the inner wall surface 56*a* of the cylinder 56 is formed into a cylindrical shape continuously extending in the axial direction. In the present embodiment, the recess portion 57*a* described in the above first or second embodiment is not formed in the control wall surface portion 57. That is, instead of the control wall surface portion 57 of the cylinder 56, the outer peripheral wall surface portion 72 is provided with the recess portion 72*a*. However, the outer peripheral wall surface portion 72 of the floating plate 70 may be provided with the recess portion 72*a*, while the control wall surface portion 57 of the cylinder 56 is provided with the recess portion 57*a*.

The outer peripheral wall surface portion 72 of the floating plate 70, provided with the recess portion 72*a*, is opposite to the control wall surface portion 57 of the inner wall surface 56*a* of the cylinder 56 in the radial direction perpendicular to the displacement axis direction of the floating plate 70. In the present embodiment, the recess portion 72*a* is formed in the outer peripheral wall surface portion 72 to be recessed radially inside, thereby being separated from the control wall surface portion 57. The recess portion 72*a* is formed into a circular ring shape that is symmetrical with respect to the displacement axis direction of the floating plate 70 and a center axis of the cylinder 56. In the third embodiment, the recess portion 72*a* is positioned in the outer wall surface portion 72 approximately at a center portion in the displacement axis direction of the floating plate 70, as an example. However, the axial position of the recess portion 72*a* may be changed.

When the floating plate 70 is displaced to be reciprocated in the displacement axis direction, the outer peripheral wall surface portion 72 of the floating plate 70 slides with respect to the control wall surface portion 57 of the cylinder 56. As described above, in a state where the outer peripheral wall surface portion 72 slides with respect to the control wall surface portion 57, a slight clearance is formed between the control wall surface portion 57 and the outer peripheral wall surface portion 72. The outer peripheral wall surface portion 72 is provided with a plurality of communication grooves (not shown) extending along the displacement axis direction of the floating plate 70. Thus, the fuel flowing into the pressure control chamber 53 easily flows from a space between one end surface of the floating plate 70 and the abutting surface 90, to a space between the other end surface of the floating plate 70 and the pressure receiving surface 61, via the communication grooves.

In the third embodiment, the recess portion 72*a* is provided in the outer peripheral wall surface portion 72 at the center portion in the displacement axis direction of the floating plate 70, so that the outer peripheral wall surface portion 72 of the floating plate 70 is pressed radially inside by the fuel held in the recess portion 72*a*. According to the third embodiment, because the recess portion 72*a* is formed in the outer peripheral wall surface portion 72, the attracting force between the control wall surface portion 57 and the outer peripheral wall surface portion 72 can be reduced by using the fuel held in the recess portion 72*a*, and thereby the floating plate 70 can be displaced and reciprocated smoothly in the pressure control chamber 53. As a result, the response of the floating plate 70 can be further improved.

In the third embodiment, because the recess portion 72*a* is provided in the outer peripheral wall surface portion 72 of the floating plate 70, the fuel can be held between the outer peripheral wall surface portion 72 and the control wall surface portion 57, regardless of the displacement of the floating plate 70. Thus, it is possible to effectively reduce the attracting force caused between the outer peripheral wall surface portion 72 of the floating plate 70 and the control wall surface portion 57 of the cylinder 56.

According to the third embodiment, because the recess portion 72*a* is provided to reduce the attracting force between the control wall surface portion 57 and the outer peripheral wall surface portion 72, the outer peripheral wall surface portion 72 of the floating plate 70 can smoothly slide with respect to the control wall surface portion 57, thereby improving the response of the floating plate 70 with respect to the switch operation of the pressure control valve 80.

In the fourth embodiment, the other parts are similar to those of the above-described first or second embodiment.

(Fourth Embodiment)

A fourth embodiment of the present invention will be described with reference to FIG. 7.

Figure 7:
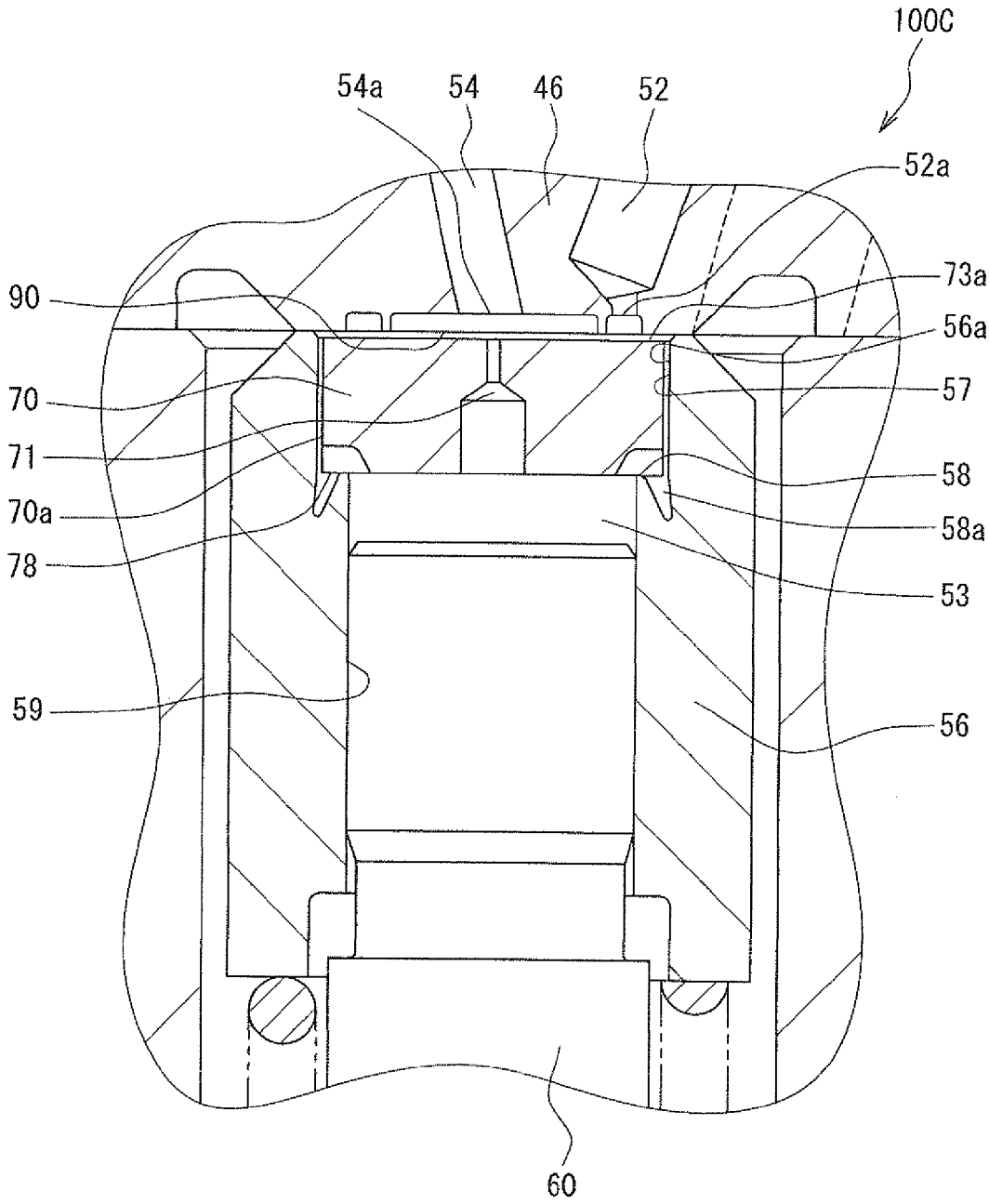
FIG. 7 is a sectional view to show another modification of FIG. 5, according to a fourth embodiment of the present invention.

The fourth embodiment shown in FIG. 7 is another modification example of the above-described second embodiment. Hereinafter, the construction of a fuel injection device 100C according to the fourth embodiment will be described in detail with reference to FIGS. 1, 2 and 7.

In the fourth embodiment, a recess portion 58*a* is provided in the inner peripheral wall surface 56*a* of the cylinder 56, at a position where a plate stopper surface portion 58 is provided. The plate stopper surface portion 58 is provided between the control wall surface portion 57 and the cylinder sliding surface portion 59 of the cylinder 56, to regulate the displacement of the floating plate 70 in the displacement axis direction. The plate stopper surface portion 58 is provided opposite to the contact surface portion 78 of the floating plate 70. The plate stopper surface portion 58 is made to contact the contact surface 78 of the floating plate 70 to regulate the displacement of the floating plate 70. In the fourth embodiment, the recess portion 58*a* is recessed from the plate stopper surface portion 58 to a side opposite to the abutting surface 90 in the displacement axis direction of the floating plate 70, so as to be extended from the control wall surface portion 57 having the cylindrical shape. The recess portion 58*a* is formed into a circular ring shape that is symmetrical with respect to the center axis of the cylinder 56.

Thus, in a state where the contact surface portion 78 of the floating plate 70 is seated on the plate stopper surface portion 58, the contact surface portion 78 is pressed toward the abutting surface 90 by the fuel held in the recess portion 58*a*. Thus, it is possible to reduce an attracting force of the contact surface portion 78 attracting to the plate stopper surface portion 58. Accordingly, when the outflow port 54*a* is made to communicate with the return channel 14*f* by the switch operation of the pressure control valve 80, the contact surface portion 78 of the floating plate 70 can be smoothly separated from the plate stopper surface portion 58. As a result, the floating plate 70 can smoothly start the displacement, thereby improving the response of the floating plate 70 with respect to the switch operation of the pressure control valve 80.

According to the fourth embodiment, the circular-ring shaped recess portion 58*a* is formed symmetrically with respect to the displacement axis direction of the floating plate 70. Therefore, the fuel in the recess portion 58*a* can be applied to the contact surface portion 78 in uniform toward the side of the abutting surface 90. Because of the fuel in the recess portion 58*a*, the attracting force of the contact surface portion 78 of the floating plate 70 to the plate stopper surface portion 58 of the cylinder 56 can be reduced in the entire periphery around the displacement axis direction. Thus, when the outflow port 54*a* and the return channel 14*f* communicate with each other and the contact surface portion 78 is separated from the plate stopper surface portion 58, the displacement axis direction of the floating plate 70 can be maintained in a direction coaxially with the axial direction of the cylinder 56.

The communication hole 71 is provided in the floating plate 70 at a center portion of the end surface 73*a*, and thereby a force is applied to the abutting surface 90 from the pressure control chamber 53, due to the fuel flowing to the flow outlet 54*a* through the communication hole 71. Even when the fuel flows through the communication hole 71 of the floating plate 70 so as to cause a force, the displacement axis direction of the floating plate 70 can be correctly maintained, and thereby the contact surface portion 78 of the floating plate 70 can be easily and correctly displaced from the plate stopper surface portion 58.

Therefore, it is possible to restrict an inclination of the displacement axis direction of the floating plate 70, and thereby the floating plate 70 can be smoothly displaced toward the abutting surface 90. As a result, the response of the floating plate 70 with respect to the switch operation of the pressure control valve 80 can be further improved.

In the fourth embodiment, the recess portion 58*a* is recessed to the side opposite to the abutting surface 90 in the displacement axis direction of the floating plate 70. Even in this case, the cylinder 56 having the recess portion 58*a* is a member different from the valve body 46 having the abutting surface 90, and the cylinder 56 having the recess portion 58*a* is assembled to the valve body 46 having the abutting surface 90. Therefore, the recess portion 58*a* can be easily formed.

In the present embodiment, other parts of the fuel injection device may be similar to that described in the first or second embodiment.

(Fifth Embodiment)

A fifth embodiment of the present invention will be described with reference to FIG. 8.

Figure 8:
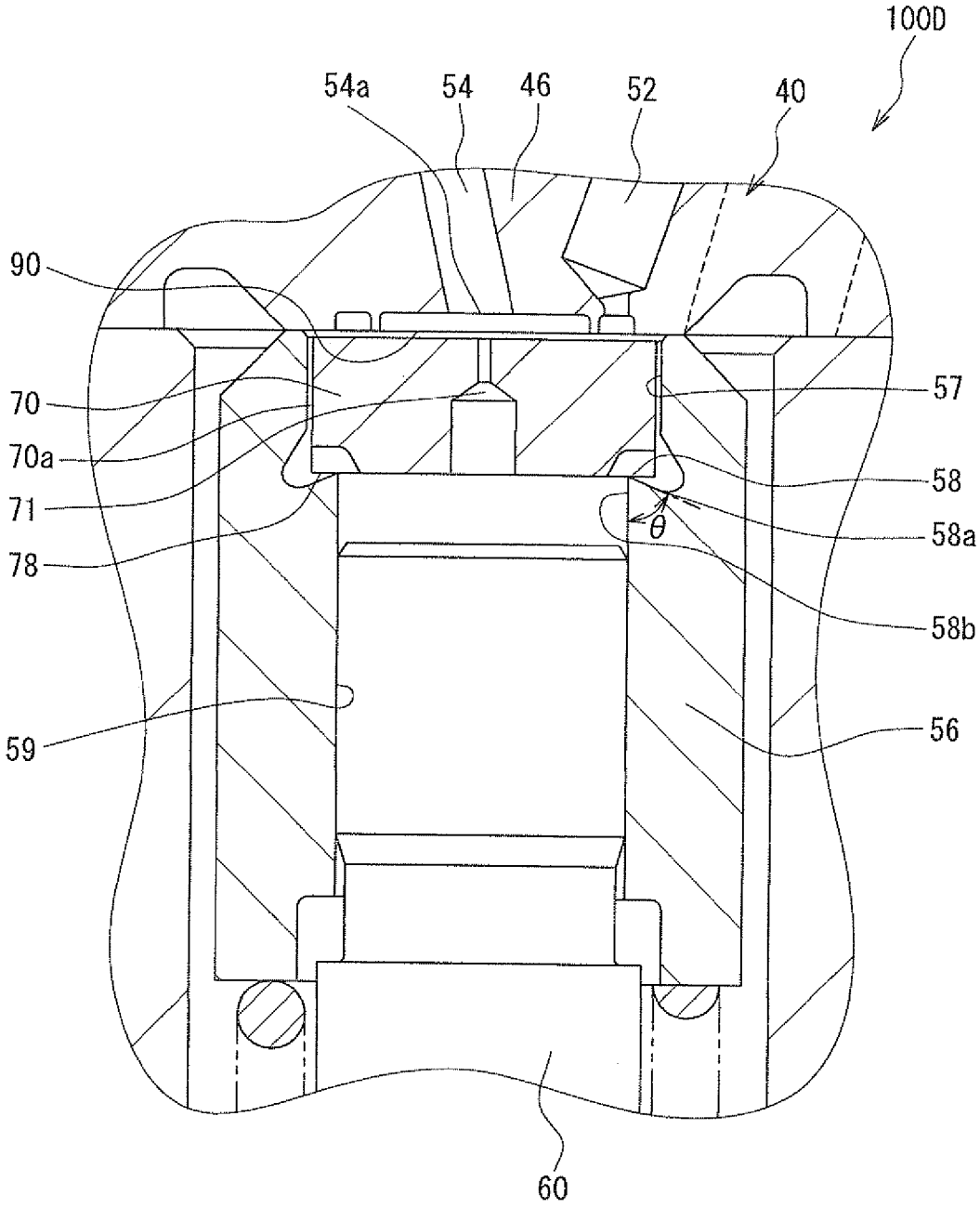
FIG. 8 is a sectional view to show a modification example of FIG. 7, according to a fifth embodiment of the present invention.

The fifth embodiment shown in FIG. 8 is a modification example of the above-described fourth embodiment. In the fifth embodiment, the construction of a fuel injection device 100D will be described in detail based on FIG. 8.

A cylinder 56 of a control body 40 is provided with an inner wall surface which defines a control wall surface portion 57, a cylinder sliding surface portion 59, a plate stopper surface portion 58 and a recess portion 58*a*. Each of the control wall surface portion 57 and the cylinder sliding surface portion 59 is a cylindrical hole portion formed in the inner peripheral wall of the cylinder 56. The control wall surface portion 57 is provided opposite to the outer peripheral surface 70*a* of the floating plate 70 in the radial direction of the cylinder 56. The cylinder sliding surface portion 59 is provided in the cylinder 56 such that the nozzle needle 60 is slidable along the axial direction of the nozzle needle 60.

The plate stopper surface portion 58 is configured opposite to the contact surface portion 78 of the floating plate 70, to regulate the displacement of the floating plate 70 in the direction approaching the nozzle needle 60. The plate stopper surface portion 58 is made to contact the contact surface 78 of the floating plate 70 so as to regulate the displacement of the floating plate 70 in the direction separating from the abutting surface 90.

The recess portion 58*a* is formed in the inner wall surface of the cylinder 56 to extend from the control wall surface portion 57 to the plate stopper surface portion 58. The recess portion 58*a* is configured to be recessed more radially outside of the cylinder 56 as toward the side of the nozzle needle 60 in the axial direction. The recess portion 58*a* is formed in a circular ring shape along the circumferential direction of the cylinder 56, so that the plate stopper surface portion 58 contacts the contact surface portion 78 of the floating plate 70 in a circular line. That is, the plate stopper surface portion 58 line-contacts the contact surface portion 78 of the floating plate 70 in a circular shape. Because the recess portion 58*a* is formed into a shape continuously extending in a range from the control wall surface portion 57 to the plate stopper surface portion 58, the contact surface portion 78 line-contacts the plate stopper surface portion 58 at an inner peripheral side of the plate stopper surface portion 58.

A support portion 58*b* is provided in the cylinder 56 to support the plate stopper surface portion 58. Because the recess portion 58*a* is formed into the ring shape expanding more radially outside of the cylinder 56 as toward the side of the nozzle needle 60 in the axial direction, a radial dimension (i.e., width dimension in an axial cross section) of the support portion 58*b* becomes larger as toward the side of the nozzle needle 60 in the axial direction. When an angle θ of the support portion 58*b* between the cylinder sliding surface portion 59 and the recess portion 58*a* is larger than 45 degrees, the strength of the support portion 58*b* can be effectively increased.

According to the fifth embodiment, because the contact surface portion 78 of the floating plate 70 is pressed toward the side of the abutting surface 90 in uniform by the fuel held in the recess portion 58*a*, the attracting force of the contact surface portion 78 to the plate stopper surface portion 58 can be reduced by the fuel held in the recess portion 58*a*. Accordingly, when the outflow port 54*a* is made to communicate with the return channel 14*f* by the switch operation of the pressure control valve 80, the contact surface portion 78 of the floating plate 70 can be smoothly separated from the plate stopper surface portion 58. As a result, the floating plate 70 can smoothly start the displacement, thereby improving the response of the floating plate 70 with respect to the switch operation of the pressure control valve 80.

In the fifth embodiment, because the recess portion 58*a* is formed such that the plate stopper surface portion 58 line-contacts the contact surface portion 78, the contact area between the plate stopper surface portion 58 and the contact surface portion 78 becomes small. Thus, it is possible to reduce the attracting force of the contact surface portion 78 to the plate stopper surface portion 58. Accordingly, when the outflow port 54*a* is made to communicate with the return channel 14*f* by the switch operation of the pressure control valve 80, the contact surface portion 78 of the floating plate 70 can be smoothly separated from the plate stopper surface portion 58. As a result, the response of the floating plate 70 can be further improved.

In the fifth embodiment, the contact surface portion 78 line-contacts the plate stopper surface portion 58 at a position adjacent the inner periphery of the plate stopper surface portion 58. Because the contact portion of the plate stopper surface portion 58 contacting the contact surface portion 78 is set adjacent to the inner periphery of the plate stopper surface portion 58, the contact area between the plate stopper surface portion 58 and the contact surface portion 78 can be effectively reduced. Thus, it is possible to further reduce the attracting force of the contact surface portion 78 to the plate stopper surface portion 58. As a result, the start of the displacement of the floating plate 70 can be rapidly performed, and the response of the floating plate 70 can be further improved.

In the fifth embodiment, because the radial dimension of the support portion 58*b* is increased as toward the side of the nozzle needle 60 in the axial direction, the strength of the support portion 58*b* can be increased even when the floating plate 70 line-contacts the plate stopper surface portion 58. Thus, even when the fuel injection device 100D is used for a long time, the line-contact portion of the support portion 58*b* of the cylinder 58 contacting the contact surface portion 78 can be accurately maintained. Thereby, the durability of the fuel injection device 100D can be increased while the response of the valve portion 50 can be improved in the fuel injection device 100D.

In the fifth embodiment, because the contact surface portion 78 of the floating plate 70 line-contacts the plate stopper surface portion 58, the stress may be easily collected at the line-contact portion. Thus, even in a case where the weight of the floating plate 70 is reduced to improve the smooth displacement, because the recess portion 58*a* is provided in the cylinder 56, the recess portion 58*a* can be easily formed.

In the fifth embodiment, the other parts of the fuel injection device may be similar to that described in the first or second embodiment.

(Sixth Embodiment)

Figure 9:
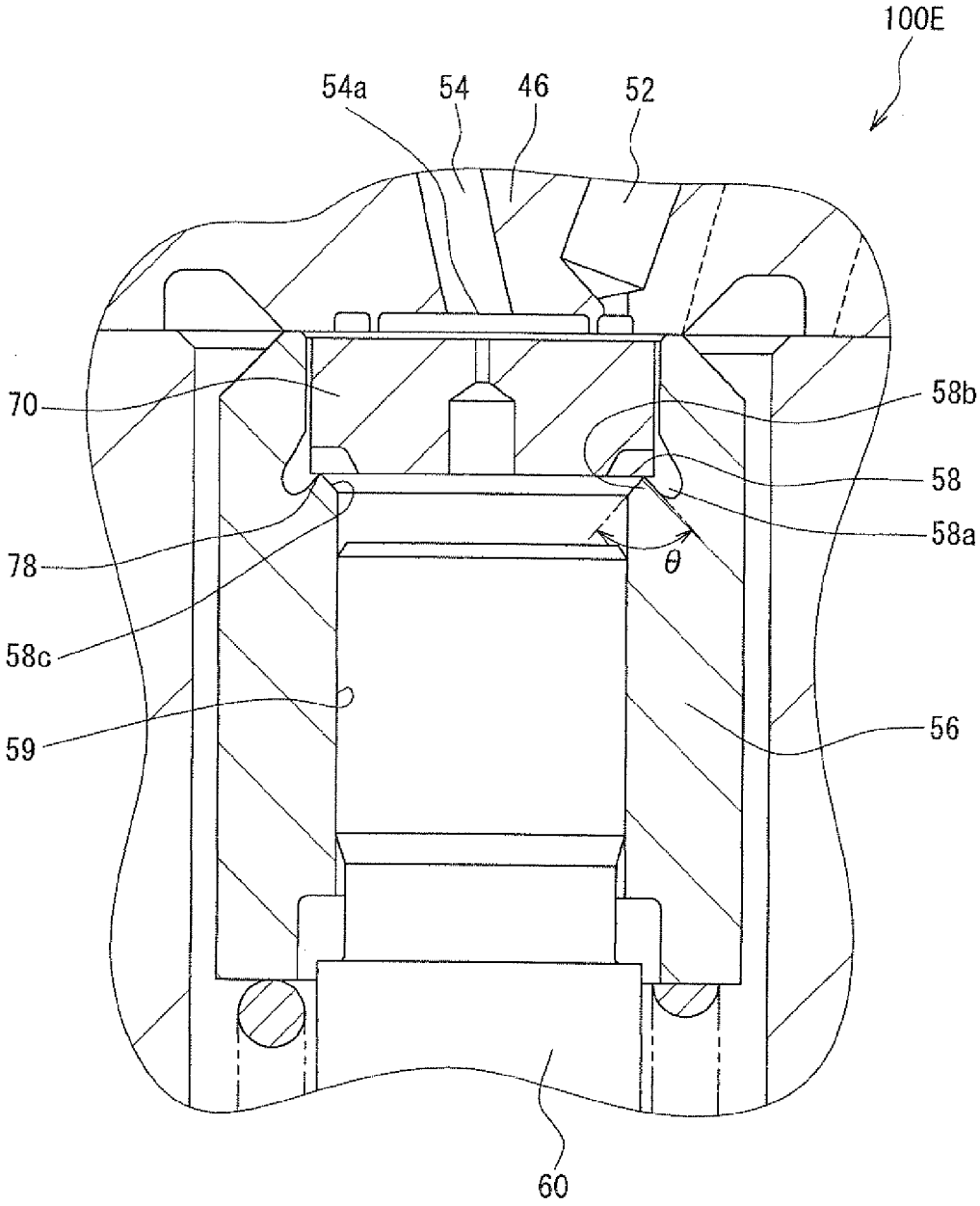
FIG. 9 is a sectional view to show a modification of FIG. 8, according to a sixth embodiment of the present invention.

A sixth embodiment of the present invention will be described with reference to FIG. 9. The sixth embodiment shown in FIG. 9 is a modification example of the above-described fifth embodiment. In a fuel injection device 100E of the sixth embodiment, a cylinder 56 is provided with a recess portion 58*a*. Hereinafter, the construction of the fuel injection device 100E according to the sixth embodiment will be described in detail based on FIGS. 1, 2 and 9.

In the sixth embodiment, the cylinder 56 is provided with a chamfer portion 58*c*, in addition to the cylinder sliding surface portion 59 and the plate stopper surface portion 58, the recess portion 58*a* and the support portion 58*b* described in the fifth embodiment. The chamfer portion 58*c* is formed by chamfering an angle portion between the cylinder sliding surface portion 59 and the plate stopper surface portion 58. Because the chamfer portion 58*c* and the recess portion 58*a* are formed, the plate stopper surface portion 58 line-contacts the contact surface portion 78. In the sixth embodiment, the contact surface portion 78 line-contacts the plate stopper surface portion 58 at a position between the inner periphery and the outer periphery of the plate stopper surface portion 58.

The radial dimension (i.e., a width in the axial cross section shown in FIG. 9) of the support portion 58*b* becomes larger as toward the side of the nozzle needle 60 in the axial direction. The recess portion 58*a* is formed into a circular shape expanding more radially outside of the cylinder 56 as toward the side of the nozzle needle 60 in the axial direction, similarly to the above-described fifth embodiment. In addition, in the axial cross section of the cylinder 56 shown in FIG. 9, an angle θ of the support portion 58*b* between the chamfer portion 58*c* and the recess portion 58*a* is set at an obtuse angle. Thus, the strength of the support portion 58*b* can be effectively increased.

In the sixth embodiment, because the recess portion 58*a* and the chamfer portion 58*c* are formed such that the plate stopper surface portion 58 line-contacts the contact surface portion 78, the contact area between the plate stopper surface portion 58 and the contact surface portion 78 becomes small. Thus, it is possible to reduce the attracting force between the contact surface portion 78 and the plate stopper surface portion 58. Accordingly, when the outflow port 54*a* is made to communicate with the return channel 14*f* by the switch operation of the pressure control valve 80, the contact surface portion 78 of the floating plate 70 can be smoothly separated from the plate stopper surface portion 58. As a result, the response of the floating plate 70 can be effectively improved in the fuel injection device 100E.

According to the sixth embodiment, because the chamfer portion 58*c* is formed, the radial dimension of the support portion 58*b* can be increased. Therefore, even when the plate stopper surface portion 58 line-contacts the contact surface portion 78 of the floating plate 70, the strength of the support portion 58*b* can be effectively increased. Thus, even when the fuel injection device 100E is used for a long time, the line-contact portion of the support portion 58*b* of the cylinder 58 contacting the contact surface portion 78 can be accurately maintained. Thereby, the durability of the fuel injection device 100E can be increased while the response of the floating plate 70 can be improved in the fuel injection device 100E.

In the fifth embodiment, other parts of the fuel injection device may be similar to that described in the first or second embodiment.

(Other Embodiments)

Although the present invention has been fully described in connection with the preferred embodiments thereof with reference to the accompanying drawings, it is to be noted that various changes and modifications will become apparent to those skilled in the art.

For example, in the above-described embodiments, the recess portion 72*a*, 57*a*, 58*a* is provided in any one of the control wall surface portion 57 of the cylinder 56 or the outer peripheral wall surface portion 72 of the floating plate 70, or in a plate stopper surface portion 58 of the cylinder 56. However, the recess portion may be formed in the inner wall surface 56*a* of the cylinder 56 and the outer wall surface 70*a* of the floating plate 70, at any position where the inner wall surface 56*a* of the cylinder 56 and the outer wall surface 70*a* of the floating plate 70 are capable of abutting on each other. For example, the recess portions 72*a*, 57*a* may be formed respectively in both the control wall surface portion 57 of the cylinder 56 and the outer peripheral wall surface portion 72 of the floating plate 70. Alternatively, the recess portions 72*a*, 58*a* may be formed respectively in both the contact surface portion 78 of the floating plate 70 and the plate stopper surface portion 58 of the cylinder 56. The recess portion 58*a* may be provided to continuously extend from the control wall surface portion 57 and the plate stopper surface portion 58 of the cylinder 56, or both the recess portions 57*a* and the recess portion 58*a* may be respectively and separately formed in the control wall surface portion 57 and the plate stopper surface portion 58 of the cylinder 56.

In the above-described embodiments, the recess portion 57*a*, 72*a*, 58*a* is formed into a circular ring shape symmetrical with respect to the displacement axis direction of the floating plate 70. However, the shape of the recess portion 57*a*, 72*a*, 58*a* is not limited to the shape of the circular ring described above. For example, plural recess parts may be arranged symmetrically around the displacement axis direction of the floating plate 70, to be positioned totally on a circular line.

In the fifth or sixth embodiment, the recess portion 58*a* is formed in the inner wall surface of the cylinder 56, so that the contact surface portion 78 of the floating plate 70 line-contacts the plate stopper surface portion 58 of the cylinder 60. The recess portion 58*a* may be formed in the inner wall surface of the cylinder 56, so that the contact surface portion 78 of the floating plate 70 surface-contacts the plate stopper surface portion 58 of the cylinder 60. Furthermore, recess portions may be formed in both of the plate stopper surface portion 58 of the cylinder 60 and the contact surface portion 78 of the floating plate 70. In addition, the line-contact portion between the contact surface portion 78 of the floating plate 70 and the plate stopper surface portion 58 of the cylinder 60 may be positioned adjacent to the inner periphery or the outer periphery of the plate stopper surface portion 58.

The present invention is not limited to the fuel injection devices 100A to 100E of the above-described embodiments. That is, if at least one of the outer wall surface portion (72, 70*a*) of the floating plate 70 and the inner wall surface portion (57, 58) of the control body 40 is provided with a recess portion (72*a*, 57*a*, 58*a*) that is recessed to a side separated from the other one of the outer wall surface portion (72, 70*a*) of the floating plate 70 and the inner wall surface portion (57, 58) of the control body 40, the other parts may be suitably changed.

In the above-described embodiments, as the drive portion for opening and closing the pressure control valve 80, a mechanism for driving the movable member 35 by using the electromagnetic force of the solenoid 31 is used. However, the drive portion other than the solenoid 31, e.g., a piezoelectric element, may be used. Even in this case, the drive portion for opening and closing the pressure control valve 80 may be operated based on the control signal from the engine controller 17.

In the above embodiments, the present invention is applied to the fuel injection device used for the diesel engine 20 that injects fuel directly into the combustion chamber 22. However, the present invention may be applied to a fuel injection device for any internal combustion engine, without being limited to the diesel engine 20. In addition, the fuel injected by the fuel injection device is not limited to light oil but may be gasoline, liquefied petroleum gas, and like. Furthermore, the present invention may be applied to a fuel injection device that injects fuel to a combustion chamber of an engine for burning fuel such as an external combustion engine.

Such changes and modifications are to be understood as being within the scope of the present invention as defined by the appended claims.

What is claimed is:

1. A fuel injection device comprising:

a control body having a pressure control chamber, the control body comprising:

a holder having a fuel supply channel and a fuel return channel;

a valve body member that includes an inflow channel that ends at an inflow port from which fuel is discharged into the pressure control chamber, and an outfow channel that begins at an outflow port that receives fuel from the pressure control chamber, and an abutting surface exposed to the pressure control chamber and having the inflow port and the outflow port opened therein;

a cylinder member that defines the pressure control chamber together with the valve body member, the cylinder member being provided with a cylindrical inner wall surface portion that extends in an axial direction of the control body;

a pressure control valve configured to open and close a connection between the outflow channel and the return channel, so as to control a pressure of the fuel in the pressure control chamber;

a valve portion including a valve member that is configured to open and close the valve portion in response to the pressure of the fuel in the pressure control chamber; and a pressing member having a cylindrical shape and arranged in the pressure control chamber and which reciprocates in the pressure control chamber in response to the opening and closing of the pressure control valve, the pressing member having a circular pressing surface opposite to the abutting surface of the valve body member, wherein the circular pressing surface of the pressing member presses the abutting surface to interrupt communication between the inflow port and the pressure control chamber when the pressure control valve opens to permit communication between the outflow channel and the return channel, the circular pressing surface of the pressing member is displaced and separated from the abutting surface to open the inflow port of the abutting surface to the pressure control chamber when the pressure control valve closes to prevent communication between the outflow channel and the return channel, the pressing member has an outer wall surface portion that is opposite to the cylindrical inner wall surface portion of the cylinder member, the pressing member being capable of contacting the cylindrical inner wall surface portion of the cylinder member, at least one of the outer wall surface portion of the pressing member and the cylindrical inner wall surface portion of the cylinder member is provided with a recess portion that is recessed with respect to the other of the outer wall surface portion of the pressing member and the cylindrical inner wall surface portion of the cylinder member, and the pressing member has therein a communication through hole through which the outflow port communicates with the pressure control chamber when the circular pressing surface abuts on the abutting surface.

2. The fuel injection device according to claim 1, wherein the cylindrical inner wall surface portion of the cylinder member is provided opposite to the outer wall surface portion of the pressing member in a radial direction of the cylindrical inner wall surface portion, and at least one of the cylindrical inner wall surface portion of the cylinder member and the outer wall surface portion of the pressing member is provided with the recess portion.

3. The fuel injection device according to claim 1, wherein the recess portion is provided symmetrically with respect to the axial direction.

4. The fuel injection device according to claim 3, wherein the recess portion is a ring shape extending circularly around the axial direction.

5. The fuel injection device according to claim 2, wherein the outer wall surface portion of the pressing member is slidable with respect to the cylindrical inner wall surface portion of the cylinder member when the pressing member is displaced in the pressure control chamber.

6. The fuel injection device according to claim 1, wherein the recess portion is provided in the outer wall surface portion of the pressing member to be recessed inside of the pressing member.

7. The fuel injection device according to claim 1, wherein the cylinder member includes a stopper surface portion provided to contact a contact surface portion of the pressing member that is located opposite to the circular pressing surface in the axial direction, thereby regulating displacement of the pressing member between the abutting surface and the stopper surface portion.

8. The fuel injection device according to claim 7, wherein at least one of the contact surface portion of the pressing member and the stopper surface portion is provided with the recess portion such that the contact surface portion of the pressing member line-contacts the stopper surface portion at a contact portion.

9. The fuel injection device according to claim 8, wherein the recess portion is provided in the stopper surface portion such that the contact surface portion of the pressing member line-contacts the stopper surface portion.

10. The fuel injection device according to claim 9, wherein the cylinder member has a support portion configured to support the stopper surface portion, the support portion has a radial dimension in an axial cross section of the cylinder member, and the radial dimension is increased in the axial direction as toward a side of the valve member.

11. The fuel injection device according to claim 8, wherein the contact portion is positioned closer to an inner periphery of the stopper surface portion than an outer periphery of the stopper surface portion.

12. The fuel injection device according to claim 7, wherein the recess portion is a shape symmetrical with respect to the axial direction.

13. The fuel injection device according to claim 12, wherein the recess portion is a circular ring shape extending around the axial direction.

14. The fuel injection device according to claim 7, wherein the recess portion is formed in the cylinder member continuously in a range from the inner wall surface portion to the stopper surface portion.

15. The fuel injection device according to claim 7, wherein the inner wall surface portion and the stopper surface portion of the cylinder member are respectively provided with the recess portions separated from each other.

16. The fuel injection device according to claim 1, wherein the communication through hole extends in the pressing member from a center portion of the pressing surface in an axial direction of the pressing member.

* * * * *